US008297013B2

(12) United States Patent
Ueda et al.

(10) Patent No.: US 8,297,013 B2
(45) Date of Patent: Oct. 30, 2012

(54) FIREPROOF RESIN SASH

(75) Inventors: Akira Ueda, Saitama (JP); Kazuhiro Okada, Saitama (JP); Masaki Tono, Saitama (JP); Yukitoshi Hashimoto, Tokyo (JP)

(73) Assignee: Sekisui Chemical Co., Ltd., Osaka (JP)

( * ) Notice: Subject to any disclaimer, the term of this patent is extended or adjusted under 35 U.S.C. 154(b) by 0 days.

(21) Appl. No.: 10/558,017

(22) PCT Filed: May 26, 2004

(86) PCT No.: PCT/JP2004/007538

§ 371 (c)(1),
(2), (4) Date: Nov. 23, 2005

(87) PCT Pub. No.: WO2004/104350

PCT Pub. Date: Dec. 2, 2004

(65) Prior Publication Data

US 2006/0254164 A1 Nov. 16, 2006

(30) Foreign Application Priority Data

May 26, 2003 (JP) ..... 2003-147865
May 26, 2003 (JP) ..... 2003-147866

(51) Int. Cl.

| | |
|---|---|
| ***E04C 2/00*** | (2006.01) |
| ***E04C 2/38*** | (2006.01) |
| ***E04C 2/54*** | (2006.01) |
| ***E06B 3/00*** | (2006.01) |

(52) U.S. Cl. ..... 52/232; 52/204.5; 52/784.11; 52/656.3

(58) Field of Classification Search ..... 52/232, 52/204.5, 204.1, 784.11, 656.3–656.5, 656.7
See application file for complete search history.

(56) References Cited

U.S. PATENT DOCUMENTS 4,109,423 A * 8/1978 Perrain ..... 52/1
(Continued)

FOREIGN PATENT DOCUMENTS

DE 200 20 844 U1 5/2001
(Continued)

OTHER PUBLICATIONS

"Expantrol", http://multimedia.3m.com/mws/mediawebserver?66666UuZjcFSLXTt4X&X4xfEEVuQEcuZgVs6EVs6E666666--.*

(Continued)

*Primary Examiner* — Mark Wendell
*Assistant Examiner* — Ryan Kwiecinski
(74) *Attorney, Agent, or Firm* — Sughrue Mion, PLLC

(57) ABSTRACT

A fireproof resin sash that is usable in fire zones or the like is provided, regarding which fireproof performance is easily imparted to a general non-fireproof resin sash without modification of the structure thereof.

In a fireproof resin sash 1, vertical frame members 11 and 12 and lateral frame members 13 and 14 that are synthetic resin members having a plurality of hollows along the longitudinal directions thereof are combined with each other to constitute an opening body 10, and vertical rail members 21 and 22 and lateral rail members 23 and 24 are combined with each other to constitute screens 20 that support windowpanes 25. Fireproof sheets 15 and 15A made up of thermally expandable fireproof material are inserted into hollows selected from the hollows of the members so that fireproof surfaces can be formed in the direction along the glass surfaces. Preferably, the thermally expandable fireproof material is formed with material having a coefficient of volumetric expansion that increases 3 to 50 times after the material is being heated for 30 minutes under radiant heat flux of 50 kW/m$^2$ and a stress of 0.05 kgf/cm$^2$ or higher at a breaking point after volumetric expansion measured by a compression tester with an indenter of 0.25 cm$^2$. In addition, the fireproof sheets may be inserted together with rolled steel members or wood members into the hollows.

5 Claims, 10 Drawing Sheets

U.S. PATENT DOCUMENTS

| | | | | | |
|---|---|---|---|---|---|
| 4,221,092 | A | * | 9/1980 | Johnson | 52/232 |
| 4,221,771 | A | * | 9/1980 | van der Heem | 423/420.2 |
| 4,493,173 | A | * | 1/1985 | Kohaut | 52/220.8 |
| 5,414,962 | A | * | 5/1995 | Forbis et al. | 49/454 |
| 5,687,532 | A | * | 11/1997 | Torrey | 52/656.3 |
| 5,694,731 | A | * | 12/1997 | Tonsmann et al. | 52/656.3 |
| 6,327,825 | B1 | | 12/2001 | Sanders et al. | |
| 6,327,826 | B1 | * | 12/2001 | Mann | 52/204.1 |
| 6,747,074 | B1 | * | 6/2004 | Buckingham et al. | 523/179 |
| 6,848,227 | B2 | * | 2/2005 | Whitty | 52/232 |
| 2003/0175497 | A1 | * | 9/2003 | Kobe et al. | 428/317.9 |
| 2005/0210797 | A1 | * | 9/2005 | Hees | 52/455 |

FOREIGN PATENT DOCUMENTS

| | | | | |
|---|---|---|---|---|
| GB | 2 309 728 | A | | 8/1997 |
| JP | 57-108385 | | | 7/1982 |
| JP | 60-23582 | | | 2/1985 |
| JP | 60-76942 | | | 5/1985 |
| JP | 6076942 | | * | 5/1985 |
| JP | 61-43914 | | | 12/1986 |
| JP | 1-19759 | Y2 | | 6/1989 |
| JP | 02140383 | A | * | 5/1990 |
| JP | 02157339 | A | * | 6/1990 |
| JP | 06-89622 | | * | 9/1994 |
| JP | 6-89622 | B2 | | 11/1994 |
| JP | 09-226031 | | | 9/1997 |
| JP | 2000-54753 | A | | 2/2000 |
| JP | 2001-262942 | | | 9/2001 |
| JP | 2002-088942 | | | 3/2002 |
| JP | 2002-146942 | A | | 5/2002 |
| JP | 2002-172181 | A | | 6/2002 |
| KR | 2003-0016966 | A | | 3/2003 |

OTHER PUBLICATIONS

"Palusol", http://www.positivepressure.com/Folder__Palusol__E.pdf.*

"Palusol", http://www.odice.com/UK/ODC03M3110.htm.*

Standard Sieve Table, Graphit Kropfmuhl AG, http://www.graphite.de/englisch/index.php?menueID=101.*

Expandable Graphite, Graphit Kropfmuhl AG, http://www.graphite.de/englisch/pdf/blaehgraphitprospekt__e.pdf.*

Machine Translation of JP-06-89622, Apr. 22, 2011.*

Supplementary European Search Report issued on Jun. 25, 2012 from the European Patent Office in corresponding European Application No. 04 734 893.3.

* cited by examiner

FIG. 8

| | Example 1 | Example 2 | Example 3 | Comparative Example 1 |
|---|---|---|---|---|
| Epoxy Monomer | 40 | – | 40 | |
| Epoxy Hardener | 60 | – | 60 | |
| Butyl Rubber | – | 42 | – | |
| Polybutene | – | 50 | – | |
| Hydrogenated Petroleum Resin | – | 8 | – | |
| Ammonium Polyphosphate | 100 | 100 | – | |
| Thermally Expandable Graphite | 100 | 30 | 150 | |
| Aluminium Hydroxide | – | 50 | – | |
| Calcium Carbonate | 100 | 150 | 150 | |
| Sheet Thickness (mm) | 1 | 3 | 1 | |
| Coefficient of Volume Expansion | 25 | 9 | 35 | |
| Breaking Point Stress ($kgf/cm^2$) | 0.5 | 1.5 | 0.08 | |
| Fireproof Performance | G | G | G | P Penetration in 5 minutes |

FIG. 9

| | Example 4 | Example 5 | Example 6 | Example 7 | | Comparative Example 1 |
|---|---|---|---|---|---|---|
| | | | | Opening Frame Body | Screen | |
| Epoxy Monomer | 40 | – | 40 | – | 40 | |
| Epoxy Hardener | 60 | – | 60 | – | 60 | |
| Butyl Rubber | – | 42 | – | 42 | – | |
| Polybutene | – | 50 | – | 50 | – | |
| Hydrogenated Petroleum Resin | – | 8 | – | 8 | – | |
| Ammonium Polyphosphate | 100 | 50 | 100 | 50 | 100 | |
| Thermally Expandable Graphite | 100 | 120 | 100 | 120 | 100 | |
| Aluminium Hydroxide | – | 30 | – | 30 | – | |
| Calcium Carbonate | 100 | 100 | 100 | 100 | 100 | |
| Sheet Thickness (mm) | 1 | 1.5 | 1 | 1.5 | 1 | |
| Coefficient of Volume Expansion | 25 | 30 | 25 | 30 | 25 | |
| Breaking Point Stress (kgf/cm$^2$) | 0.5 | 0.1 | 0.5 | 0.1 | 0.5 | |
| Wood Member | Hemlock Member | Hemlock Member | Japanese Ash Glued Laminated Wood | | Hemlock Member | |
| Fireproof Performance | G | G | G | G | | P Penetration in 5 minutes |

Before the thermally expandable fireproof material expands in volume
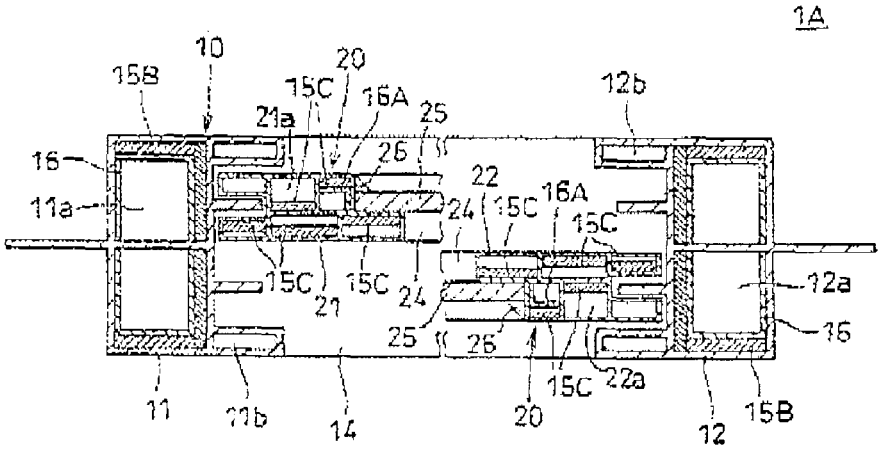
After the thermally expandable fireproof material expands in volume
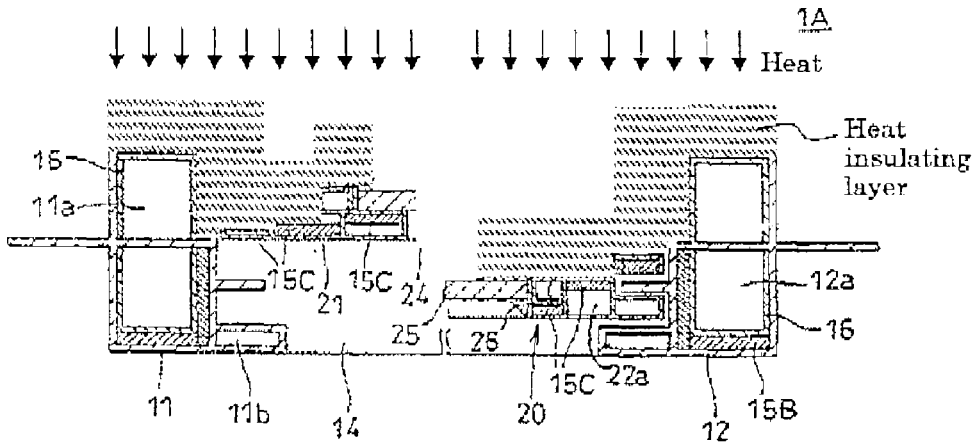
Fig. 10

FIREPROOF RESIN SASH

TECHNICAL FIELD

The present invention relates to a synthetic resin sash used for an opening portion of a structure such as a house, and particularly relates to a fireproof resin sash usable for an opening portion in fire zones or the like.

BACKGROUND ART

Conventionally, resin sashes that are excellent in terms of heat insulating and soundproofing properties have been widespread mainly in cold climates, instead of aluminum sashes having bodies formed with aluminum. Such resin sashes are excellent in terms of heat insulating properties, resulting in less dew condensation. Therefore, habitability can be improved.

However, such resin sashes are inferior in terms of fireproof performance, so that they have not been usable for fireproof doors or windows used in fire zones, quasi-fire zones, or the like.

Thus, a sash member described in Patent document 1 below was invented.

The sash member comprises a synthetic resin body that has at least two hollows, the cross-sectional shape of which is substantially rectangular. The hollows are horizontally disposed in the interior and the exterior directions and the neighboring hollows overlap each other across at least half of the region thereof. The sash member further comprises rolled steel members loaded into the hollows and fireproof material loaded into the hollows. In such a constitution, the rolled steel members comprise the center wall portion that extends along the substantially central part between the interior and the exterior surfaces of the hollows and a flange wall portion that extends from both edges of the center wall portion to the interior and the exterior surfaces, and the fireproof material is disposed along the interior and exterior of the central wall portion of the rolled steel members.

Patent document 1: Japanese Patent Publication (Kokoku) No. 6-89622 B (1994)

However, regarding the structure of the sash member described in Patent document 1 above, the hollows, into which the rolled steel member and the fireproof material are loaded, overlap each other across at least half of the region thereof so as to prevent deterioration of fireproof performance resulting from destruction of resin portions by fire. Thus, such sash member is required to have a specific structure for fire protection. In addition, the rolled steel member and the fireproof material that are loaded into all hollows cause increase in the weight of the sash, resulting in problems such as handling difficulties upon production and construction and sensations of massiveness when opening and closing a movable type sash. Further, since the rolled steel member needs to be loaded into all hollows and the fireproof material needs to be applied to the interior and exterior surfaces of the rolled steel member, the operation upon production of the sash becomes complicated and time-consuming. In addition, the rolled steel member is loaded into hollows substantially without leaving a gap therein, so that dew condensation is generated inside of the resin sash due to a heat bridge. Consequently, the rolled steel member tends to become corroded.

The present invention has been made in view of the above problems. The object of the present invention is to provide a fireproof resin sash regarding which fireproof performance is easily imparted to a general resin sash without modification of the structure thereof, such sash being usable in fire zones or the like. Another object of the present invention is to provide a fireproof resin sash that is lightweight and excellent in terms of handleability, so that a simplified production process and cost reduction can be achieved. Further, an object of the present invention is to provide a fireproof resin sash that can immediately provide fireproof performance by preventing penetration in hollows in the event of an outbreak of fire. Furthermore, an object of the present invention is to provide a fireproof resin sash that can prevent corrosion of rolled steel members used therein.

DISCLOSURE OF THE INVENTION

Inventors of the present invention have conducted intensive studies and experimentation so as to achieve the above objects. As a result, the inventors have found that excellent fireproof performance can be achieved by inserting thermally expandable fireproof material into hollow portions of a general non-fireproof resin sash. This has led to the completion of the present invention. In addition, the inventors have found that the further excellent fireproof performance can be achieved by inserting thermally expandable fireproof material, metallic members, and/or wood members into the hollow portions.

Specifically, the fireproof resin sash according to the present invention comprises synthetic resin members having a plurality of hollows along the longitudinal direction thereof and the fireproof resin sash supports fireproof plate members. The fireproof resin sash is characterized in that thermally expandable fireproof material is inserted into hollows selected from the hollows along the longitudinal direction thereof, thereby forming fireproof surfaces in the direction along the surfaces of the plate members. The cross-sectional shapes of the synthetic resin members have a plurality of hollows, which are formed along the longitudinal direction thereof. The thermally expandable fireproof material is inserted into hollows selected from among the hollows. In addition, a plurality of sections of the thermally expandable fireproof material may be inserted into a single hollow. Preferably, the thermally expandable fireproof material is a molded product in a form that they can easily be inserted into hollows.

The fireproof surfaces are referred to as continuous surfaces formed with fireproof heat insulating layers that are formed without gap due to volumetric expansion of the thermally expandable fireproof material by heating. For instance, in an elevation view of the fireproof resin sash, preferably, the fireproof surfaces are formed as substantially continuous surfaces with the thermally expandable fireproof material, which are disposed without gap so as to substantially cover the front surfaces of the synthetic resin members. Specifically, the fireproof surfaces composed of the thermally expandable fireproof material are formed as substantially continuous surfaces, excluding thick resin portions between a plurality of the hollows. A plurality of sections of the thermally expandable fireproof material that constitute the fireproof surfaces can be movably disposed in the depth direction without causing functional problems.

In the preferred specific embodiment of the fireproof resin sash according to the present invention, the fireproof resin sash comprises the thermally expandable fireproof material that is disposed without gap in a view from the direction orthogonal to the direction along the surfaces of the plate members. Specifically, the fireproof surfaces are formed as substantially continuous surfaces without leaving gaps therebetween.

In the fireproof resin sash of the present invention that has the above constitution, the thermally expandable fireproof material is selectively inserted into hollows of the synthetic resin members, thereby forming the fireproof surfaces. Thus, portions burned due to combustion of the synthetic resin members are filled with the thermally expandable fireproof material that has thermally expanded by heating due to fire or the like, so that a fireproof heat insulating layer is formed without gap, thereby preventing flame penetration. Thus, fireproof performance can be provided. In addition, the thermally expandable fireproof material immediately expands after a wide area thereof is heated, so as to fill portions burned due to combustion of the synthetic resin members, thereby preventing flame penetration. Thus, fireproof performance can be achieved. Therefore, the fireproof resin sash can conveniently be produced, and the dew condensation found in metal sashes can be prevented.

Preferably, the fireproof resin sash comprises the thermally expandable fireproof material that is formed in a strip or a tape form so as to be inserted in a manner such that the broad surface thereof is disposed in the direction along the surfaces of the plate members. The broad surface is referred to as a surface corresponding to the long side of the cross-section of the thermally expandable fireproof material in a strip or a tape form. With such constitution, the broad surface of the thermally expandable fireproof material is immediately heated such that a fireproof heat insulating layer is instantly formed. Thus, continuous fireproof surfaces can be formed with a small quantity of the thermally expandable fireproof material over substantially the entire surface of an opening portion of the fireproof resin sash, resulting in material cost reduction, and leading to the improvement of fireproof performance.

Preferably, the thermally expandable fireproof material is inserted into the hollows while leaving a certain space therein. With such constitution, weight reduction of the fireproof resin sash can be achieved in a state whereby the fireproof performance thereof is maintained. As a result, the applicability of the fireproof resin sash can be improved.

Preferably, the thermally expandable fireproof material is supported by adhesion on the inner surfaces of the hollows. Tackiness may be imparted to the thermally expandable fireproof material. Also, an adhesive layer may be formed on one side of the thermally expandable fireproof material. The adhesive layer can be formed by coating the layer with adhesive such that tackiness is imparted. With such constitution, when the thermally expandable fireproof material is inserted into the hollows of the synthetic resin members, and the material can adhere to the surface of the inner wall thereof, so that construction can be simplified.

In another embodiment of the fireproof resin sash according to the present invention, metallic members and/or wood members are further inserted into the hollows along the longitudinal direction thereof. Examples of the metallic members include various types of rolled steel members. The metallic members and the thermally expandable fireproof material are inserted separately or together into some of or all of the hollows. The metallic members provide secondary effects for improving fireproof performance, so that they are used for cost reduction by reducing the thickness of thermally expandable fireproof material and are used at weak parts in terms of fire protection.

Examples of the wood members include various types thereof. The wood members and the thermally expandable fireproof material are inserted separately or together into some of or all of the hollows. A plurality of sections of the thermally expandable fireproof material or a plurality of the wood members may be inserted together into a single hollow.

When the metallic members are inserted into the hollows of the synthetic resin members, the metallic members can prevent flame penetration in a certain manner even when the synthetic resin members have been burned after the fireproof resin sash has been heated due to fire or the like. Thus, the desired fireproof performance can be secured even using thermally expandable fireproof material having reduced thickness, leading to the achievement of cost reduction. With the use of the metallic members, the quantity of the thermally expandable fireproof material that is inserted into the hollows can be reduced, so that weight and cost reduction can be attempted.

When the wood members are inserted into hollows of the synthetic resin members, portions burned due to combustion of the synthetic resin members are filled with the thermally expandable fireproof material that has thermally expanded when being heated by fire or the like, thereby preventing flame penetration. Thus, fireproof performance can be achieved. In addition, the wood members are unlikely to vibrate, to warp, or to curve due to hot wind in the event of fire. Accordingly, the wood members advantageously function in terms of fireproof performance and provide synergistic effects for improving fireproof performance when used in combination with the thermally expandable fireproof material. With the use of the wood members, the quantity of the thermally expandable fireproof material that is inserted into the hollows can be reduced, so that weight and cost reduction can be attempted.

Further, in the preferred specific embodiment of the fireproof resin sash according to the present invention, the thermally expandable fireproof material is formed with material that has a coefficient of volumetric expansion that increases 3 to 50 times after the material is heated for 30 minutes under radiant heat flux of 50 $kW/m^2$ and a stress of 0.05 $kgf/cm^2$ or higher at a breaking point after volumetric expansion measured by a compression tester with an indenter of 0.25 $cm^2$ at a compression speed of 0.1 m/s.

With such constitution, portions burned due to combustion of the synthetic resin members of the resin sash in the event of fire are filled with the thermally expandable fireproof material that has volumetrically expanded. In addition, the thermally expandable fireproof material has a certain stress at a breaking point after the volumetric expansion so that it would not be blown off by the hot wind in the event of fire or the like. Further, the heat insulating layer that has expanded by heating stands without support so as to prevent flame penetration.

Furthermore, in another preferred specific embodiment of the fireproof resin sash according to the present invention, the thermally expandable fireproof material is formed with a resin composition material comprising 10 to 300 parts by weight of thermally expandable inorganic substances and 30 to 400 parts by weight of inorganic filler, which correspond to 40 to 500 parts by weight of the sum thereof, with respect to 100 parts by weight of the resin component. Preferably, the thermally expandable fireproof material is a molded product of the above resin composition. With such constitution, the thermally expandable fireproof material expands by heating due to fire or the like, so as to obtain a necessary coefficient of volumetric expansion. After expansion thereof, residues that have the certain heat insulating properties and the certain strength can be formed, so that stable fireproof performance can be achieved.

BRIEF DESCRIPTION OF THE DRAWINGS

FIG. 8 shows a table indicating fireproof performance obtained in Examples 1-3 in connection with the contents (parts by weight) and in the Comparative Example.

FIG. 9 shows a table indicating fireproof performance obtained in Examples 4-7 in connection with the contents (parts by weight) and in the Comparative Example 1.

FIG. 10 shows the states of the fireproof resin sash before and after the fireproof material expanding in volume.

BEST MODE FOR CARRYING OUT THE INVENTION

Figure 1:
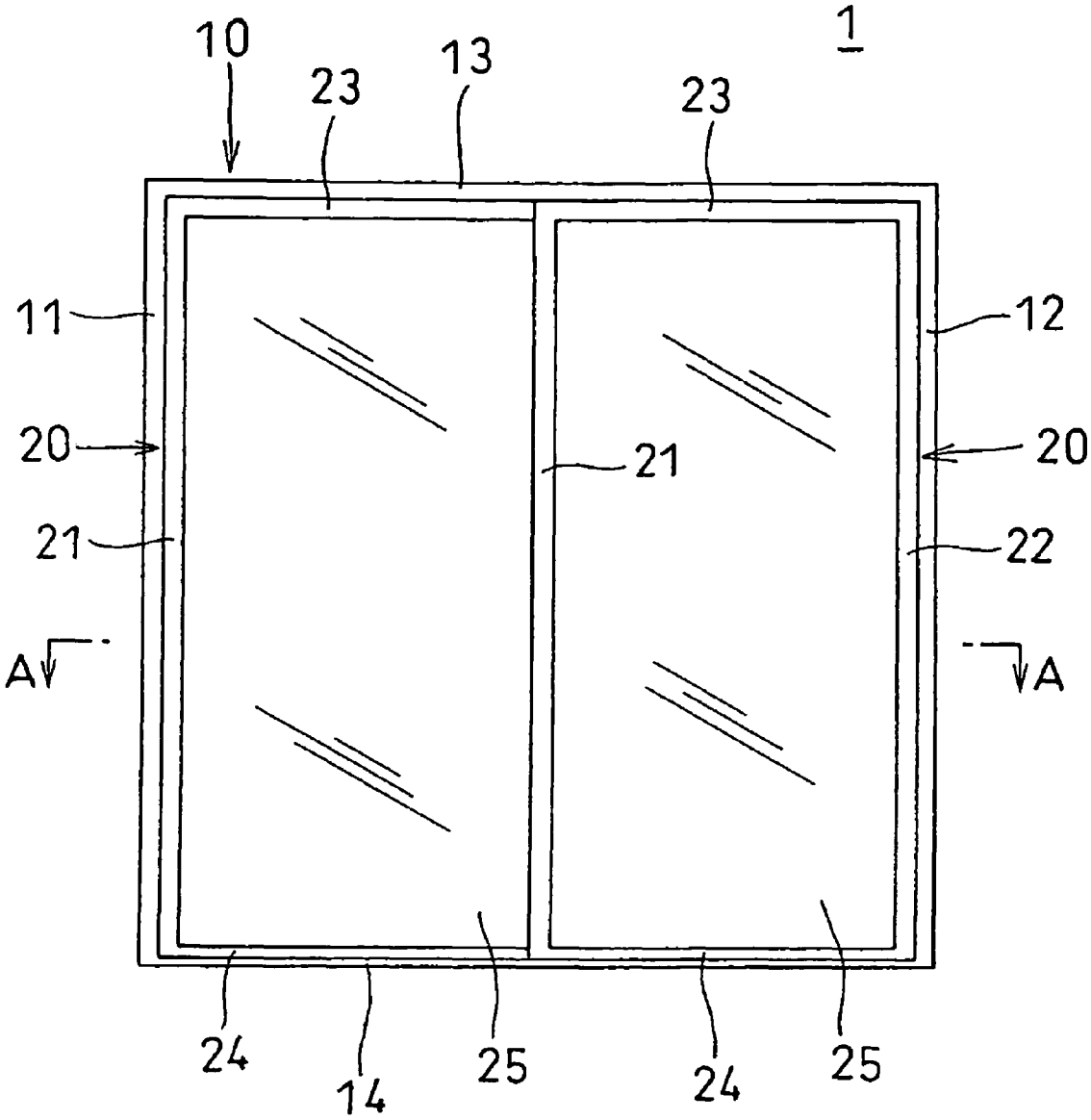
FIG. 1 shows an elevation view of the first embodiment of the fireproof resin sash according to the present invention.
Figure 2:
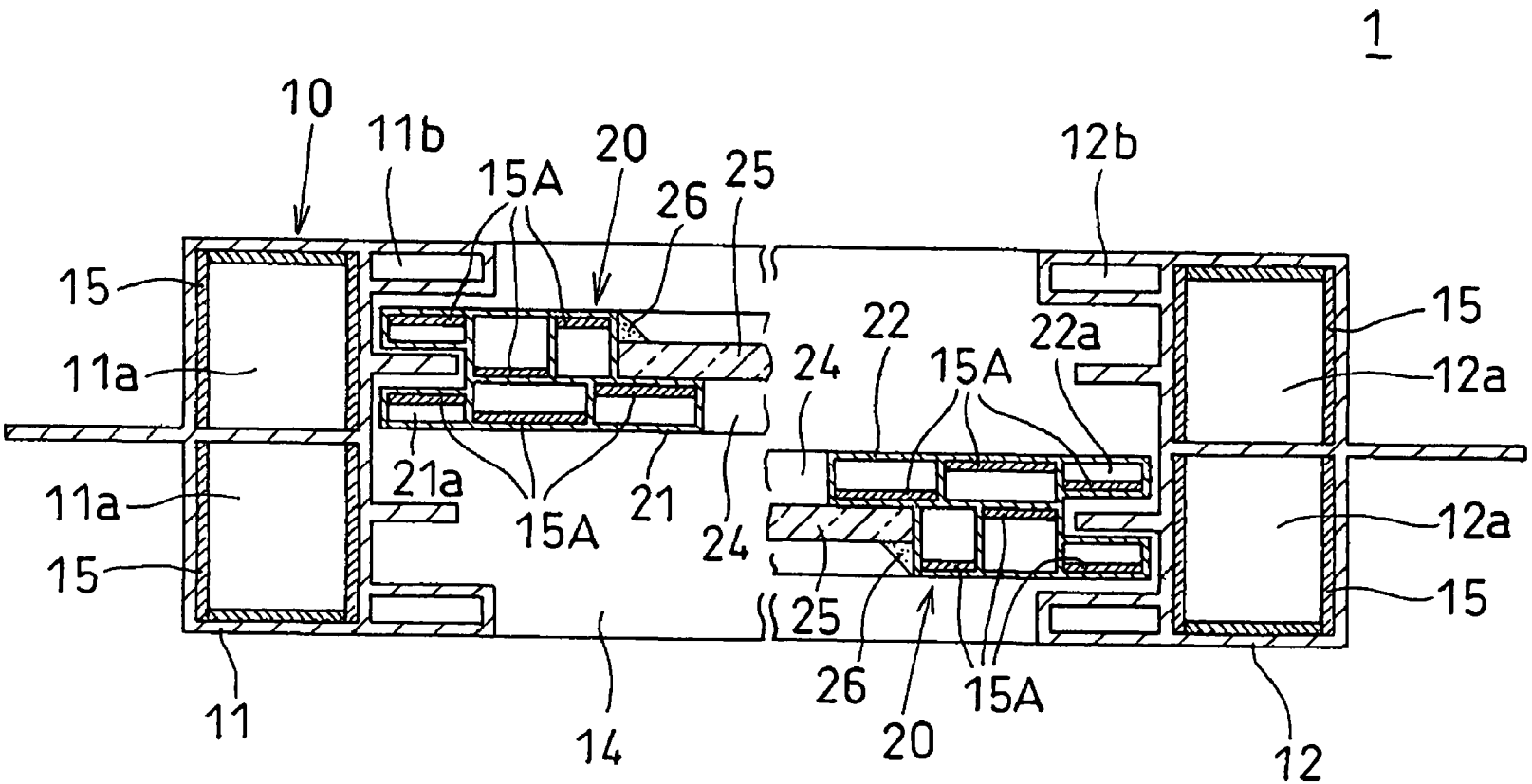
FIG. 2 shows a cross-sectional view of the main part (Example 1) along the line A-A of FIG. 1.

The first embodiment of the fireproof resin sash according to the present invention will hereafter be explained in detail based on the drawings. FIG. 1 shows an elevation view of a double sliding window that serves as the fireproof resin sash according to the present embodiment. FIG. 2 shows a cross-sectional view of the main part of FIG. 1 along the line A-A. In FIGS. 1 and 2, a fireproof resin sash 1 is fixed on a rectangular opening portion formed in a structure such as a house, and comprises an opening frame 10 that constitutes the outer circumference thereof and two horizontally movable sliding screens 20 and 20 inside of the opening frame 10.

The opening frame 10 is composed of vertical frame members 11 and 12 on the left and the right sides thereof and lateral frame members 13 and 14 on the top and the bottom sides thereof. An inner space surrounded by these members 11-14 constitutes an opening portion thereof. The two screens 20 share the substantially same constitution in terms of the structure thereof and have a function of closing the opening portion. The screens 20 are formed into a rectangle with vertical rail members (stiles) 21 and 22 on the left and the right sides thereof and lateral rail members 23 and 24 on the top and the bottom sides thereof, and have a meeting point where the vertical rail members horizontally overlap with each other at the center portion of the sash. The opening frame 10 and the screens 20 and 20 are made up of a combination of synthetic resin members that are composed of vertical and lateral frame members 11-14 and vertical and lateral rail members 21-24, respectively.

As described above, in the fireproof resin sash 1, the two screens 20 are slidably supported by the opening frame 10, and the screens 20 and 20 support windowpanes 25, which are made of wired glass and are disposed on the inner circumference with vertical and lateral rail members 21-24 that constitute outer circumference frames thereof. The windowpanes 25 constitute a fireproof plate member so as to constitute a parting plane between the interior and the exterior sides of the fireproof resin sash 1. In addition, examples of such parting plane are not limited to a windowpane having light transmittivity and may include those having light resistance such as a metal plate member or a calcium silicate board.

The constitution of the fireproof resin sash 1 of the present embodiment is not particularly limited and may be any known constitution on the conditions that the frame members 11-14 and the rail members 21-24 on the top, the bottom, the right, and the left sides thereof are formed with extruded synthetic resin material and have hollows penetrating therethrough along the longitudinal direction, and that the shape of the cross-section thereof that is disposed orthogonally to the longitudinal direction has one or more hollow spaces. Examples of synthetic resin used for the frame members and the rail members that constitute the sash include rigid polyvinyl chloride, ABS resin, and any other synthetic resin. Preferably, rigid polyvinyl chloride is advantageously used in terms of fireproof performance. Each of the frame members and the rail members can be molded using such resin by means of extrusion molding or injection molding.

First, the vertical frame members 11 and 12 that constitute the opening frame 10 will be explained in detail. The vertical frame members 11 and 12 are formed by cutting a long member obtained by extrusion molding of synthetic resin such as rigid polyvinyl chloride and have hollows penetrating therethrough along the longitudinal direction. The cross-sectional shapes of the vertical frame members 11 and 12 comprises two large rectangle hollows 11*a* and 12*a* and two hollows 11*b* and 12*b* having a short width that extend from an end portion of the inner and the outer walls forming the hollows 11*a* and 12*a* to the opening side. In addition, the lateral frame members 13 and 14 that constitute the opening frame 10 have a plurality of hollows penetrating therethrough in the longitudinal direction in a similar manner (not shown).

The vertical rail members 21 and 22 on the left and the right sides of the screen 20 are formed by cutting a long member obtained by extrusion molding of synthetic resin in a similar manner, and their cross-sectional shapes have six hollows 21*a* and 22*a* penetrating therethrough in the longitudinal direction. The lateral rail members 23 and 24 that constitute the screen 20 have a plurality of hollows penetrating therethrough in the longitudinal direction in a similar manner (not shown). To the inner space formed with the vertical and the lateral rail members, the windowpanes 25 made of wired glass are fixed. The windowpanes 25 are disposed at step portions of the vertical rail members 21 and 22 and are fixed using rubber sealant or sealant 26.

In the fireproof resin sash 1 of the present embodiment, fireproof sheets comprising the thermally expandable fireproof material are inserted into hollows of the frame members 11-14 and the rail members 21-24 that are synthetic resin members constituting the opening frame and the screens 20, respectively. Specifically, fireproof sheets 15 prepared by cutting a sheet of the thermally expandable fireproof material in strip forms are selectively inserted into the large hollows 11*a* and 12*a* of the vertical frame member 11. The fireproof sheets 15 have an adhesive layer on one side thereof. A sheet is inserted into each of two large hollows of the vertical frame member 11, and is fixed with the adhesive layer to three surfaces of the hollows excluding the surface of the central wall therebetween. Also, fireproof sheets are inserted into hollows penetrating through the lateral frame members 13 and 14 in the longitudinal direction thereof in a similar manner (not shown).

In addition, fireproof sheets 15A prepared by cutting a sheet of the thermally expandable fireproof material in strip forms are inserted into each of six hollows 21*a* and 22*a* of the vertical rail members 21 and 22 of the screens 20. The plate-like fireproof sheets 15A are inserted into the hollows in a manner such that the sheets have contact with the wall surfaces thereof that are parallel to the glass surfaces. Also, fireproof sheets are inserted into hollows penetrating through lateral rail members 23 and 24 on the top and the bottom sides of the screens 20 in the longitudinal direction thereof (not shown).

As described above, many fireproof sheets 15 are inserted into hollows of the opening frame 10 and the screens 20 and 20 in the direction along the surfaces of the windowpanes 25, and are fixed in an airtight manner to the surface of the inner wall of the hollows via an adhesive layer thereof. The fireproof sheets 15 are disposed parallel to the surfaces of the windowpanes 25 that constitute fireproof plate members, so as to form fireproof surfaces. The thus formed fireproof surfaces tightly cover substantially the entire surface along the windowpanes, excluding the thick portions of the frame members and the rail members orthogonal to the glass surfaces.

Specifically, in a front view of the fireproof resin sash 1 from the interior or the exterior side thereof, that is, from the direction orthogonal to the direction along the glass surfaces, the fireproof sheets 15 are disposed at the front of hollows of the vertical rail members 21 and 22 and the lateral rail members 23 and 24 that surround the outer circumference of the windowpanes 25 and 25 in the center of the sash. The fireproof sheets 15 are also disposed at the front of hollows of the vertical frame members 11 and 12 and the lateral frame members 13 and 14 of the opening frame 10, which supports the screens 20 and 20. The fireproof surfaces are formed in a manner such that the broad surfaces of all the fireproof sheets are disposed parallel to the surfaces of the windowpanes 25.

The fireproof sheets 15 and 15A prepared by cutting a sheet material made of the thermally expandable fireproof material having a few millimeters thickness are inserted along the wall surfaces of the hollows parallel to the surfaces of the windowpanes 25. The thermally expandable fireproof material to be inserted in the hollows of the synthetic resin members may be in the form of molded products having the shapes and the sizes corresponding to those of the hollows. Preferably, a molded product in a strip or a tape form is used so that the molded product can be inserted regardless of shapes or sizes of the hollows. In addition, the thermally expandable fireproof material that constitutes the fireproof sheets 15 and 15A will hereafter be described in detail in terms of the composition thereof, for example.

The thermally expandable fireproof material that constitutes the fireproof sheets 15 and 15A used in the present embodiment indicates a material that volumetrically expands when exposed to a high temperature in the event of fire or the like, so as to form an expandable heat insulating layer. Such material is not particularly limited on the condition that portions burned due to combustion of the synthetic resin members such as the frame members 11-14 and the rail members 21-24 in the event of fire are filled with an expandable heat insulating layer of the thermally expandable fireproof material, thereby preventing flame penetration. Examples of the thermally expandable fireproof material include a resin composition comprising a resin component that contains a thermally expandable inorganic substance or the like that will hereafter be described, and a molded product prepared with a fireproof coating material. In view of ease of production, a molded product comprising a resin composition is preferred.

The thermally expandable fireproof material that constitutes the fireproof sheets 15 and 15A is not particularly limited, on the condition that portions burned due to combustion of the synthetic resin members are filled with an expandable component as described above. Preferably, such material has a coefficient of volumetric expansion that increases 3 to 50 times after the material is heated for 30 minutes under radiant heat flux of 50 kW/m$^2$. In the case of a coefficient of volumetric expansion that increases less than 3 times, the expandable component thereof cannot sufficiently fill the burned portions of the synthetic resin, resulting in deterioration of fireproof performance. In the case of a coefficient of volumetric expansion that increases more than 50 times, the strength of the expandable heat insulating layer decreases, resulting in deterioration of flame penetration preventive effects. Therefore, preferably, the coefficient of volumetric expansion is within the range described above. More preferably, the material has a coefficient of volumetric expansion that increases 5 to 40 times and further preferably 8 to 35 times.

In addition, preferably, the thermally expandable fireproof material comprises an expandable heat insulating layer capable of standing without support in the event of fire. When a synthetic resin portion is thick or the synthetic resin used is rigid polyvinyl chloride resin, the expandable heat insulating layer causes an increase in a carbonized component of the synthetic resin portion, so that the layer may stand without support due to a composite of the carbonized component and the expandable component therein. In such case, the expandable heat insulating layer alone does not necessarily stand without support.

In the case of the thermally expandable fireproof material, the expandable heat insulating layer causes an increase in a carbonized component in the synthetic resin member, so that the layer may stand without support due to a composite of the carbonized component and the expandable component therein as described above. In such case, the expandable heat insulating layer alone does not necessarily stand without support. However, when the synthetic resin member is thin, or a amount of a carbonized component of ABS resin or the like is small, preferably, the thermally expandable fireproof material comprises the expandable heat insulating layer capable of standing without support. The expandable heat insulating layer requires strength to stand without support. In terms of such strength, a stress of 0.05 kgf/cm$^2$ or higher at a breaking point is required when a sample of the layer after volumetric expansion is measured by a compression tester with an indenter of 0.25 cm$^2$ at a compression speed of 0.1 m/s. In the case of a stress of less than 0.05 kgf/cm$^2$ at a breaking point, the expandable heat insulating layer cannot stand without support, resulting in deterioration of fireproof performance. A stress of 0.1 kgf/cm$^2$ or higher at a breaking point is more preferred.

When the thermally expandable fireproof material is a molded product in a strip or a tape form, the width thereof may be shorter or longer than, or consistent with, the widths of the hollows into which the molded product is inserted on the condition that sufficient fireproof performance can be obtained. Such molded product having a great width may be bent or rolled so as to be inserted into the hollows. Either a thick or a thin molded product may be used on the condition that sufficient fireproof performance can be obtained. However, when the molded product is deformed as described above, the molded product needs to become thinner than that capable of being inserted in the hollows.

The thermally expandable fireproof material to be inserted needs to have a length equivalent to the overall length of each frame member and rail member that constitute the synthetic resin sash. However, when a hollow portion has a narrow space and the expandable component of the thermally expandable fireproof material fills the overall length of the hollow portion, the above length may be shorter than the overall length. The thermally expandable fireproof material may be inserted into hollows at any positions in a manner such that the expandable component of the thermally expandable fireproof material fills the hollows in a continuous manner, and that the expandable component and the carbonized component of the synthetic resin are disposed so as to be parallel to the glass surfaces of the synthetic resin sash. Specifically, unless the fireproof sheets are disposed to fill the hollows in a continuous manner, the empty hollow portions would be penetrated by fire, so that effective fireproof functions could not be obtained.

In the case of a molded product in a strip or a tape form, examples of fixation of the fireproof sheets in the hollows include a method of using adhesive or bond, a method of fixing with screws, a method of inserting round-shaped foam members or the like into spaces between the hollows and the sheets, and a method of injecting a foam material and allowing it to foam for fixation. In the case of fixation using adhesive or bond, a molded product that has previously been coated with adhesive or bond may be inserted. Adhesive or bond may be applied to a molded product immediately before inserting it. A substrate having an adhesive or a bond layer may be laminated on a molded product. Further, a molded product itself may have tackiness. In addition, a molded product having a shape and a size corresponding to that of a relevant hollow may be inserted as it is, and may be inserted using the fixation methods described above. The fireproof resin sash can easily be obtained merely by inserting the fireproof sheets into and along the hollows.

Preferably, the thermally expandable fireproof material has rigidity in terms of ease of insertion and fixation thereof in the hollows. For instance, preferably, the durometer hardness of a material that forms the thermally expandable fireproof material is 65 or more, more preferably 75 or more, and further preferably 80 or more upon measurement using the type A durometer in conformity with JIS K 7215. As durometer hardness becomes larger, the rigidity of the thermally expandable fireproof material increases. As a result, in addition to the improvement in terms of insertion into the hollows in a convenient manner, fixation in the hollows can be facilitated. Consequently, production of the fireproof resin sash can be simplified.

Next, the thermally expandable fireproof material that constitutes the fireproof sheets 15 and 15A described above will be described in detail.

Examples of the resin component of the resin composition used, which constitutes the thermally expandable fireproof material that is inserted into the hollows of the fireproof resin sash 1, include, but are not particularly limited to, polyolefin resins such as polypropylene resin, polyethylene resin, polybutene resin, and polypentene resin, and thermoplastic resins such as polystyrene resin, acrylonitrile-butadiene-styrene resin, polycarbonate resin, polyphenylene ether resin, acrylic resin, polyamide resin, and polyvinyl chloride resin.

In addition, instead of the thermoplastic resin described above, the examples of a rubber substance that can be used include natural rubber (NR), isoprene rubber (IR), butadiene rubber (BR), 1,2-polybutadiene rubber (1,2-BR), styrene-butadiene rubber (SBR), chloroprene rubber (CR), nitrile rubber (NBR), butyl rubber (IIR), ethylene-propylene rubber (EPR, EPDM), chlorosulfonated polyethylene (CSM), acrylic rubber (ACM, ANM), epichlorohydrin rubber (CO, ECO), highly vulcanized rubber (T), silicone rubber (Q), fluororubber (FKM, FZ), and urethane rubber (U). Further, the examples of the thermosetting resin that may be used include polyurethane, polyisocyanate, polyisocyanurate, phenolic resin, epoxy resin, urea resin, melamine resin, unsaturated polyester resin, and polyimide.

Among these resins, polyolefin resin or a rubber substance, particularly polyethylene resin, is preferred since it can be formed under the expansion temperature thereof when a thermally expandable inorganic substance described below, particularly thermally expandable graphite, is mixed therewith. Examples of polyethylene resin include ethylene homopolymer, copolymer mainly comprising ethylene, a mixture of such polymers, ethylene-vinyl acetate copolymer, and ethylene-ethyl acrylate copolymer.

Examples of the copolymer mainly comprising ethylene described above include ethylene-α-olefin-copolymer mainly comprising an ethylene part. Examples of α-olefin include 1-hexene, 4-methyl-1-penten, 1-octene, 1-butene, and 1-pentene. Specific examples of commercially available ethylene-α-olefin-copolymer products include "CGCT" (DuPont Dow) and "EXACT" (ExxonMobil Chemical). Such polyolefin resins may be used alone or in combinations of two or more. In addition, for the purpose of improving fireproof performance, the rubber substances described above are preferred since a large amount of filler can be mixed therewith.

Further, as described above, preferably, the resin composition itself has tackiness so that the fireproof sheets 15 and 15A comprising the thermally expandable fireproof material can be fixed in the hollows of the synthetic resin members or can adhere to rolled steel members described below. Examples of a method of obtaining such resin composition include addition of tackifying resin, plasticizer, fats and oils, or low molecular weight compounds to a rubber substance. Examples of tackifying resin include, but are not limited to, rosin, a rosin derivative, dammar resin, copal, coumarone-indene resin, polyterpene, non-reactive phenolic resin, alkyd resin, hydrogenated petroleum resin, xylene resin, and epoxy resin.

It is difficult to make tackifying plasticizer alone exhibit tackiness. However, tackiness can be improved with the combined use of the above tackifying resin. Examples of such plasticizer include phthalate ester plasticizer, phosphate ester plasticizer, adipate ester plasticizer, sebacate ester plasticizer, ricinoleate ester plasticizer, polyester plasticizer, epoxy plasticizer, and paraffin chloride.

Since tackifying fats and oils have effects equivalent to those of the plasticizers, they can be used to provide plasticity and to function as agents for controlling tackiness. Examples of such fats and oils include, but are not limited to, animal oil and fat, vegetable oil, mineral oil, and silicone oil. In addition, a low molecular weight compound can be used for the improvement of low temperature resistance and fluidity control, in addition to the provision of tackiness. Examples of such low molecular weight compound include, but are not limited to, low molecular weight butyl rubber and a polybutene compound.

In addition, phenol resin and epoxy resin are preferred in view of the improvement of fireproof performance by enhancing the flame retardancy of the resin itself. Particularly, in terms of the wide selection range for molecular structure and ease of controlling fireproof performance and mechanical physical properties of a resin composition, epoxy resin is preferred. Such epoxy resin is not particularly limited, and basically it can be obtained by allowing an epoxy group-containing monomer to react with a hardener. Examples of the epoxy group-containing monomer include a bifunctional glycidylether monomer, a bifunctional glycidylester monomer, and a polyfunctional glycidylether monomer.

Examples of a bifunctional glycidylether monomer include a polyethylene glycol monomer, a polypropylene glycol monomer, a neopentylglycol monomer, a 1,6-hexanediol monomer, a trimethylolpropane monomer, a bisphenol A monomer, a bisphenol F monomer, a propylene oxide bisphenol A monomer, and a hydrobisphenol A monomer. Further, examples of a bifunctional glycidylester monomer include a hexahydrophthalic anhydride monomer, a tetrahydrophthalic anhydride monomer, a dimer acid monomer, and a p-hydroxybenzoic acid monomer.

Examples of a polyfunctional glycidylether monomer include a phenol novolac monomer, an ortho cresol monomer, a DPP novolac monomer, and a dicyclopentadiene-phenol monomer. These may be used alone or in combinations of two or more. The above epoxy group-containing monomer may be used alone or in combinations of two or more.

Examples of a hardener used to obtain epoxy resin by allowing the hardener to react with an epoxy group-containing monomer include polyaddition type hardener and catalyst type hardener. Examples of a polyaddition type hardener include aliphatic polyamine or modified amine thereof, aromatic polyamine, acid anhydride, polyphenol, and polymercaptan. Further, examples of a catalyst type hardener include tertiary amine, imidazoles, Lewis acid, and Lewis base. The above hardeners may be used alone or in combinations of two or more.

In addition, other resins may be added to epoxy resin. As the amount of another resin added is increased, the effects of epoxy resin become unexpressed. Thus, preferably, the ratio of the amount of another resin added to epoxy resin is 5:1 or less (weight ratio). The epoxy resin may be provided with flexibility so as to be inserted into hollows having various shapes and sizes. Examples of a method of providing flexibility include the following methods of:

(1) increasing the molecular weight between crosslinking points;
(2) reducing the crosslinking density;
(3) introducing a soft molecular structure;
(4) adding plasticizer;
(5) introducing the interpenetrating polymer network (IPN) structure;
(6) introducing dispersed rubber-like particles; and
(7) introducing microvoids.

The above method (1) comprises allowing a long chain epoxy monomer and/or a hardener to react in advance so as to result in an extended distance between the crosslinking points for expression of the flexibility. Examples of the hardener used include polypropylene diamine. The above method (2) comprises allowing an epoxy monomer having a few functional groups and/or a hardener to react so as to reduce the crosslinking density in a certain area for expression of the flexibility. Examples of the hardener used include bifunctional amine, and examples of the epoxy monomer used include monofunctional epoxy.

The above method (3) comprises introducing an epoxy monomer having a soft molecular structure and/or a hardener for expression of flexibility. Examples of the hardener used include heterocyclic diamine, and examples of the epoxy monomer used include alkylene diglycol diglycidyl ether. The above method (4) comprises adding non-reactive diluents, which serve as plasticizers, such as DOP, tar, and petroleum resin.

The above method (5) comprises expressing flexibility using the interpenetrating polymer network (IPN) structure by introducing resin having a different soft structure into the crosslinked structure of an epoxy resin. The above method (6) comprises mixing and dispersing rubber particles in a liquid or a particle state in an epoxy resin matrix. Examples of the epoxy resin matrix used include polyester ether. The above method (7) comprises expressing flexibility by introducing microvoids each having a size of 1 μm or less into the epoxy resin matrix. The epoxy resin matrix to be added is polyether having a molecular weight of 1,000 to 5,000.

By controlling the rigidity and flexibility of the above epoxy resin, a flexible molded product can be obtained from a rigid plate material so that the fireproof sheets 15 and 15A are allowed to be inserted into the various types of hollows corresponding to the shapes and the sizes thereof. The resin described above may be used alone or blended in combinations of two or more types of resin for controlling melt viscosity, softness, tackiness, and other properties of resin. In addition, the resin may be subjected to crosslinking or modification within a scope where fireproof performance of the resin composition can be maintained. Examples of a method of crosslinking or modification that can be performed include, but are not particularly limited to, known methods thereof. Bridging or modification may be performed after or at the same time as the mixing of various types of fillers that are used in the present invention, or resin having been subjected to crosslinking or modification may be used.

Thermally expandable inorganic substances contained in the thermally expandable fireproof material that constitutes the fireproof sheets 15 and 15A are not particularly limited, on the condition that such substances expand by heating. Examples thereof include vermiculite, kaoline, mica, thermally expandable graphite, metal silicate, and borate. Of these, thermally expandable graphite is preferred in terms of low temperature at the initiation of expansion and high level of dilatation.

Thermally expandable graphite is a conventionally known substance, which is produced as a result of production of intercalated graphite by treating powder of natural scaly graphite, pyrolytic graphite, kish graphite, or the like with inorganic acid such as concentrated sulfuric acid, nitric acid, or selenic acid, and strong oxidizing compounds such as concentrated nitric acid, perchloric acid, perchlorate, permanganate, bichromate, or hydrogen peroxide. That is, thermally expandable graphite is a crystalline-compound in which a carbon layer structure is maintained. Preferably, such thermally expandable graphite obtained by acid treatment described above is further subjected to neutralization using ammonia, lower aliphatic amine, an alkali metal compound, an alkaline earth metal compound, or the like.

Examples of a lower aliphatic amine include monomethylamine, dimethylamine, trimethylamine, ethylamine, propylamine, and butylamine. Examples of an alkali metal compound and an alkaline earth metal compound include hydroxide such as potassium, sodium, calcium, barium, and magnesium, oxide, carbonate, sulfate, and organic acid salt.

Preferably, the particle size of thermally expandable graphite is between 20 mesh to 200 mesh. In the case of particle sizes of more than 200 mesh, dilatation of graphite becomes small so that a sufficient expandable heat insulating layer cannot be obtained. In the case of particle sizes of less than 20 mesh, dilatation of graphite becomes advantageously large. However, since the dispersibility of graphite deteriorates when being mixed with resin, deterioration of the physical properties of graphite is inevitable. Examples of commercially available thermally expandable graphite products include "GREP-EG" (Tosoh) and "GRAFGUARD" (GrafTech).

Preferably, inorganic filler is further mixed with the resin compound that constitutes the thermally expandable fireproof material. When the expandable heat insulating layer is formed, inorganic filler contained therein increases the heat capacity thereof, resulting in suppression of heat transfer, and improves the strength thereof by functioning as aggregate. Examples of the inorganic filler include, but are not limited to, metal oxides such as alumina, zinc oxide, titanium oxide, calcium oxide, magnesium oxide, iron oxide, tin oxide, antimony oxide, and ferrites; hydrated inorganic substances such as calcium hydroxide, magnesium hydroxide, aluminum hydroxide, and hydrotalcite; and metal carbonates such as basic magnesium carbonate, calcium carbonate, magnesium carbonate, zinc carbonate, strontium carbonate, and barium carbonate.

In addition to the above, examples of inorganic filler include calcium salts such as calcium sulfate, gypsum fiber, and calcium silicate, as well as silica, diatomaceous earth, dawsonite, barium sulfate, talc, clay, mica, montmorillonite, bentonite activated clay, sepiolite, imogolite, sericite, glass fiber, glass bead, silica balloon, aluminum nitride, boron nitride, silicon nitride, carbon black, graphite, carbon fiber, carbon balloon, charcoal powder, various types of metal powder, potassium titanate, magnesium sulfate (product name: MOS), lead zirconium titanate, aluminum borate, molybdenum sulfide, silicon carbide, stainless steel fiber, zinc borate, various types of magnetic powder, slag fiber, fly ash, and dehydrated sludge. These inorganic fillers may be used alone or in combinations of two or more. Preferably, such inorganic filler is a hydrated inorganic substance and/or metal carbonate.

Preferably, the above hydrated inorganic substances are used based on the fact that water generated by dehydration when heating the hydrated inorganic substances causes endothermic change, resulting in reduction of a rise in temperature, and leading to improved fireproof performance, and that remaining oxide after heating functions as an aggregate so as to improve the strength of the expandable layer. Particularly, metal hydroxides such as calcium hydroxide, magnesium hydroxide, and aluminum hydroxide are preferred since the amount of the water generated is large so that further improved fireproof performance can be provided. In addition, magnesium hydroxide and aluminum hydroxide provide dehydration effects in different temperature ranges. Thus, preferably, they are used in combination so that the temperature range where such effects are provided can be expanded. Accordingly, good suppressive effects on increases in temperature can be obtained.

The above metal carbonates are preferred based on the fact that carbon dioxide generated by decarboxylation when heating the metal carbonate promotes formation of the expandable layer, and that remaining oxide after heating functions as an aggregate so as to improve the strength of the expandable layer. Particularly, metal carbonates belonging to group II of the periodic table such as calcium carbonate, magnesium carbonate, zinc carbonate, and strontium carbonate are preferred since they tend to cause decarboxylation.

The inorganic filler particle size is preferably 0.5 μm to 100 μm, and more preferably 1 μm to 50 μm. In case a small amount of inorganic filler is added, dispersivity thereof significantly influences performance thereof so that, preferably, inorganic filler has a small particle size. However, when the particle size is less than 0.5 μm, secondary aggregation occurs, resulting in deterioration of the dispersivity. In case a large amount thereof is added, as high chargeability is achieved, the viscosity of the resin composition increases, resulting in deterioration of formability. The viscosity of the resin composition can be decreased by increasing the inorganic filler particle size. Thus, preferably, inorganic filler has a large particle size. When the particle size exceeds 100 μm, surface properties of the molded product and mechanical physical properties of the resin composition become deteriorated.

In addition, preferably, inorganic filler having a large particle size and inorganic filler having small particle size are used in combination so that high chargeability is achieved while mechanical physical properties of the expandable heat insulating layer are maintained. Examples of the inorganic filler include aluminum hydroxide such as "HIGILITE H-31" having a particle size of 18 μm (Showa Denko) and "B-325" having a particle size of 25 μm (Alcoa), and calcium carbonate such as "WHITON SB (red)" having a particle size of 1.8 μm (Bihoku Funka Kogyo) and "BF 300" having a particle size of 8 μm (Bihoku Funka Kogyo).

To the resin composition that constitutes the thermally expandable fireproof material, a phosphorus compound may be added in addition to the above components so that the strength of the expandable heat insulating layer is increased so as to improve fireproof performance. Examples of the phosphorus compound include, but are not particularly limited to, red phosphorus; various types of phosphoric ester such as triphenyl phosphate, tricresyl phosphate, trixylenyl phosphate, cresyl diphenyl phosphate, and xylenyl diphenyl phosphate; metal phosphates such as sodium phosphate, potassium phosphate, and magnesium phosphate; ammonium polyphosphates; and a compound represented by the following formula (1). In view of fireproof performance, preferably, the phosphorus compound is red phosphorus, an ammonium polyphosphate, or a compound represented by the following formula (1), and more preferably, an ammonium polyphosphate in terms of performance, safety, and cost.

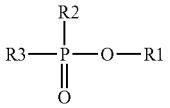

(1)

In formula (1), R1 and R3 denote hydrogen, a linear or branched alkyl group having 1 to 16 carbon atoms, or an aryl group having 6 to 16 carbon atoms. R2 denotes a hydroxy group, a linear or branched alkyl group having 1 to 16 carbon atoms, a linear or branched alkoxyl group having 1 to 16 carbon atoms, an aryl group having 6 to 16 carbon atoms, or an aryloxy group having 6 to 16 carbon atoms.

Commercially available red phosphorus may be used to serve as the red phosphorus. In view of moisture resistance and safety involving no spontaneous ignition upon kneading, preferably, red phosphorus particles having resin-coated surfaces and the like are used. Examples of ammonium polyphosphates include, but are not limited to, ammonium polyphosphate and melamine-modified ammonium polyphosphate. In view of handleability, preferably, ammonium polyphosphate can be used. Examples of a commercially available ammonium polyphosphates include "AP 422" and "AP 462" (Clariant) and "FR CROS 484" and "FR CROS 487" (Budenheim Iberica).

Examples of the compound represented by formula (1) include, but are not particularly limited to, methylphosphonic acid, dimethyl methylphosphate, diethyl methylphosphate, ethylphosphonic acid, propylphosphonic acid, butylphosphonic acid, 2-methylpropylphosphonic acid, t-butylphosphonic acid, 2,3-dimethylbutylphosphonic acid, octylphosphonic acid, phenylphosphonic acid, dioctyl phenylphosphonate, dimethylphosphinic acid, methylethylphosphinic acid, methylpropylphosphinic acid, diethylphosphinic acid, dioctylphosphinic acid, phenylphosphinic acid, diethylphenylphosphinic acid, diphenylphosphinic acid, and bis(4-methoxyphenyl)phosphinic acid. Preferably, the compound is t-butylphosphonic acid in terms of high flame retardancy, although it is expensive. The above phosphorus compounds may be used alone of in combinations of two or more.

When being exposed to high temperatures due to fire or the like, phosphorus compounds are modified into polyphosphoric acid compounds, which act as inorganic binders so as to improve the strength of the expandable heat insulating layer. Of the above metal carbonates, metal carbonates belonging to group II of the periodic table such as calcium carbonate, magnesium carbonate, zinc carbonate, and strontium carbonate promote formation of the expandable heat insulating layer in combined use with the above phosphorus compounds, and particularly with ammonium polyphosphate, due to the decreased temperature of decarboxylation of the metal carbonates. In addition, with the combined use of the above compounds, modification of phosphorus compounds into polyphosphoric acid compounds is promoted, so that effects that further improve the strength of the expandable heat insulating layer are provided. Particularly preferably, ammonium polyphosphate is used in combination with calcium carbonate, so that both of the above effects can be provided to a maximum extent.

Preferably, the content of thermally expandable inorganic substances in the resin composition that constitutes the thermally expandable fireproof material is 10 to 300 parts by weight per 100 parts by weight of the resin component. In the case of content of less than 10 parts by weight, the coefficient of volumetric expansion of the material is low so that the expandable heat insulating layer cannot sufficiently fill the burned portions of the synthetic resin members that constitute the resin sash, resulting in deterioration of fireproof performance. In the case of content of more than 300 parts by weight, the thermally expandable fireproof material has the significantly reduced mechanical strength, thereby losing durability in use. More preferably, the content is 20 to 250 parts by weight. Preferably, the content of inorganic fillers in the resin composition is 30 to 400 parts by weight per 100 parts by weight of the resin component. In the case of content of less than 30 parts by weight, sufficient fireproof performance cannot be obtained due to the lowered heat capacity. In the case of content of more than 400 parts by weight, the thermally expandable fireproof material has significantly reduced mechanical strength, thereby losing durability in use. More preferably, the content is 40 to 350 parts by weight.

When adding a phosphorus compound to the resin composition, the content of the phosphorus compound is 30 to 300 parts by weight per 100 parts by weight of the resin component. In the case of content of less than 30 parts by weight, sufficient effects for improving the strength of the expandable heat insulating layer cannot be provided. In the case of content of more than 300 parts by weight, the thermally expandable fireproof material has significantly reduced mechanical strength, thereby losing durability in use. More preferably, the content is 40 to 250 parts by weight.

Preferably, the sum of the contents of the thermally expandable inorganic substance and inorganic filler is 40 to 500 parts by weight per 100 parts by weight of the resin component. In the case of a sum of the contents of less than 40 parts by weight, a sufficient expandable heat insulating layer cannot be obtained. In the case of a sum of the contents of more than 500 parts by weight, the thermally expandable fireproof material has significantly reduced mechanical strength, thereby losing durability in use. More preferably, the sum of the contents is 70 to 400 parts by weight.

When further adding the phosphorus compound, preferably, the sum of the contents of phosphorus compounds, the thermally expandable inorganic substance, and the inorganic filler is 70 to 500 parts by weight per 100 parts by weight of the resin component. In the case of a sum of the contents of less than 70 parts by weight, a sufficient thermally heat insulating layer cannot be obtained. In the case of a sum of the contents of more than 500 parts by weight, the thermally expandable fireproof material has significantly reduced mechanical strength, thereby losing durability in use. More preferably, the sum of the contents is 100 to 400 parts by weight.

In addition, to the resin composition, an antioxidant based on phenol, amine, or sulfur, a metal harm inhibitor, an antistatic agent, a stabilizer, a crosslinking agent, a lubricant, a softener, a pigment, or the like may be added within the scope where physical properties thereof can be maintained. Also, a general flame retardant may be added thereto. Thus, fireproof performance can be improved due to suppressive effects on combustion using flame retardant.

As an example of a molded product of the resin composition that constitutes the thermally expandable fireproof material, a molded product having a shape and a size corresponding to that of the hollows can be obtained by preparing a molded product of the aforementioned resin composition, followed by molding, and a molded product in a strip or a tape form can be obtained by preparing a sheet-like or a rolled molded product, followed by cutting. In addition, a method wherein a solvent is added upon kneading for molding, followed by vaporization of the solvent, may be used.

The kneaded product of the resin composition can be obtained by kneading the above components with the use of an extruder, a banbury mixer, a kneader mixer, a kneading roller, or the like, and additionally with the use of an automated mortar machine, a planetary mixer, or a known kneading device in the case of thermosetting resin such as epoxy resin. In the case of a two-liquid thermosetting resin, particularly epoxy resin, a kneaded product may be prepared by separately preparing kneaded products of each of two fluids and the filler based on the above kneading method, supplying the thus obtained kneaded products using plunger pump, a snake pump, or a gear pump, and mixing the kneaded products using a static mixer, a dynamic mixer, or the like.

Examples of the molding method of the resin composition that can be used to mold the above kneaded product include known methods such as press molding, calendering molding, extrusion molding, and injection molding. Further, examples of the molding method for two-liquid thermosetting resin, particularly epoxy resin, that can be used in accordance with the shape thereof include known methods such as roll forming using a sheet molding compound (SMC) manufacturing process or the like and coater molding using a roll coater or a blade coater.

Examples of the thermosetting resin curing method used particularly for epoxy resin that can be used include, but are not limited to, known methods such as a method wherein molding and curing are continuously performed by heating using the above press or roller, or by a furnace in a molding line or the like, and a method of placing the molded resin in a furnace. In the case of molding with the use of a solvent, the solvent can be vaporized by a method similar to one described above.

Examples of a method of preparing a molded product in a strip or a tape form using the sheet-like or rolled molded product prepared by an above molding method that can be used include known methods such as cutting working, slit working, and cross-section cutting working. Preferably, the thickness of the molded product of the resin composition in a strip or a tape form is 0.1 mm to 6 mm. In the case of the thickness of less than 0.1 mm, the thickness of the expandable heat insulating layer that is formed by heating becomes thinner so that sufficient fireproof performance cannot be obtained. In the case of thickness of more than 6 mm, the molded product of the resin composition may not be inserted into the hollows. More preferably, the thickness is 0.3 mm to 4 mm.

For the improvement of the strength of the expandable heat insulating layer, a net or mat comprising a noncombustible fiber material may be laminated on the resin composition. Preferably, such net or mat comprises inorganic fiber or a metal fiber material. Preferably, examples thereof used include woven fabric made up of glass fiber (e.g., glass cloth, roving cloth, and continuous strand mat), nonwoven fabric (e.g., chopped strand mat), woven fabric made up of ceramic fiber (e.g., ceramic cloth), nonwoven fabric (e.g., ceramic mat), woven fabric or nonwoven fabric made up of carbon fiber, or a net or mat formed with lath or wire mesh.

In view of ease of production of thermally expandable fireproof material and production cost, preferably, such net or mat is formed with woven fabric or nonwoven fabric made up of glass fiber, and more preferably, glass cloth, in terms of less dispersion of glass upon production. In addition, glass cloth may be treated with melamine resin, acrylic resin, or the like for the improvement of handleability and for imparting tackiness to resin. In the case of thermosetting resin, particularly epoxy resin, the above net or mat may be impregnated with the resin composition.

The weight of 1 $m^2$ of a net or mat comprising a noncombustible fiber material is 5 g to 2,000 g. In the case of a weight of less than 5 g per 1 $m^2$, effects for improving the shape-retaining properties of the expandable heat insulating layer become lowered. In the case of a weight of more than 2,000 g, the increased sheet weight results in difficulties in construction. More preferably, the weight is 10 g to 1,000 g. Preferably, the thickness of the net or mat comprising noncombustible fiber material is 0.05 mm to 6 mm. In the case of a thickness of less than 0.05 mm, the net or mat cannot be durable in terms of expansion pressure upon expansion of the thermally expandable fireproof material. In the case of a thickness of more than 6 mm, it is difficult for a bended or rolled section of thermally expandable fireproof material to be inserted. More preferably, the thickness is 0.1 mm to 4 mm.

When the net is made up of a noncombustible fiber material, preferably, the mesh size thereof is 0.1 mm to 50 mm. In the case of a mesh size of less than 0.1 mm, the net cannot be durable in terms of expansion pressure upon expansion of the thermally expandable fireproof material. In the case of a mesh size of more than 50 mm, effects for improving the shape-retaining properties of the expandable heat insulating layer become lowered. More preferably, the mesh size is 0.2 mm to 30 mm. When the net or mat comprising a noncombustible fiber material is impregnated with a thermosetting resin composition, the net or mat may be placed in any position with respect to the direction of thickness of the thermally expandable fireproof material. Considering the improvement of the shape-retaining properties of the expandable layer, preferably, the net or mat is placed on the side of a surface exposed to flame.

For the purposes of the improvement of applicability and the strength of the expandable layer, a substrate layer may be laminated on one side or both sides of a molded product of the resin composition of the thermally expandable fireproof material. Examples of a material used for the substrate layer include fabric, nonwoven fabric composed of polyester or polypropylene, paper, plastic film, split cloth, glass cloth, aluminum glass cloth, aluminum foil, aluminum deposited film, aluminum foil laminated release paper, and laminates of these materials. Preferably, the substrate layer is made of polyethylene laminate polyester nonwoven fabric regarding ease of coating and application of adhesive or bond, and aluminum foil laminated release paper or aluminum glass cloth in view of advantageous fireproof performance. Further, the thickness of the substrate layer is arbitrarily specified unless the thickness affects fireproof performance or construction. Preferably the thickness is less than 0.25 mm.

In addition, the thermally expandable fireproof material may be formed by laminating a laminate made up of a substrate layer and a net or mat comprising a noncombustible fiber material on the surface of a sheet comprising a resin composition. Examples of the laminate include a laminate made up of aluminum glass cloth, or of polyethylene film and glass cloth. Examples of a method for laminating or disposing a substrate layer or a net or mat composed of noncombustible fiber material include a method of combining them at a step of forming a resin composition.

When the thermally expandable fireproof material is fixed in the hollows of the synthetic resin members by preliminary coating it with adhesive or bond or applying an adhesive or bond thereto upon construction, any type of adhesive or bond that adheres or sticks to the resin of the synthetic resin material may be used. Examples thereof include acrylic, epoxy, or rubber adhesive or bond. When a substrate having an adhesive layer or a bond layer is preliminarily laminated on the molded product, a substrate may be laminated upon molding and the substrate having adhesive or bond on both sides thereof may be laminated on the molded product.

The thermally expandable fireproof material is excellent in terms of fireproof performance as described above. Thus, the quantity of the thermally expandable fireproof material necessary for achievement of fireproof performance can be reduced so that weight and cost reduction of the fireproof resin sash can be attempted. In addition, as described above, a molded product in a strip or a tape form can easily be produced using known techniques. Such molded products can easily be inserted into the hollows regardless of the shapes or the sizes thereof. Therefore, the fireproof resin sash can conveniently be produced.

In the fireproof resin sash 1 of the present embodiment that has the above constitution, the fireproof sheets 15 and 15A composed of the thermally expandable fireproof material are selectively inserted into the hollows of the resin members made up of synthetic resin, so that the fireproof surfaces are formed in the direction along the surface of the windowpanes and the like. Thus, portions burned due to combustion of resin portions of the synthetic resin members are filled with the expandable heat insulating layer of the fireproof sheets in the event of fire or the like, thereby preventing flame penetration or heat transfer.

When fire occurs on the interior or the exterior side of the fireproof resin sash 1, the fireproof sheets 15 and 15A inserted into the hollows of the synthetic resin members are heated by the heat of fire. All surfaces of the fireproof sheets are disposed parallel to the windowpanes 25 so as to substantially cover the entire surface of the fireproof resin sash 1 in, for example, an elevation view. Thus, the fireproof heat insulating layer that has been formed due to thermal expansion is formed without gap across substantially the entire surface of the fireproof resin sash 1, resulting in no localized weak part thereon. Therefore, fireproof performance becomes stable.

In addition, the broad surfaces of the fireproof sheets 15 and 15A face a heat source in the event of fire so that efficient heat transfer causes immediate expansion thereof. Thus, fireproof performance can be provided quickly in the event of an outbreak of fire. That is, when the fireproof sheets are disposed vertically with respect to the parting plane, heat transfer due to fire occurs merely from the end surfaces of the fireproof sheets, so that fireproof performance cannot promptly be provided due to delay in thermal expansion. However, thermal expansion can immediately be achieved in the present invention.

Further, by adopting a constitution wherein the fireproof sheets 15 and 15A that are composed of the thermally expandable fireproof material and the windowpanes 25 made of wired glass that serves as the fireproof plate member cover the opening portion of the fireproof resin sash 1 so that the opening portion is covered with fireproof surfaces. Thus, a weak part locally found in the event of fire can be eliminated, resulting in the improvement of fireproof performance. When the fireproof sheet 15 has tackiness, or adhesive is applied on one side thereof, the sheet can adhere to the surfaces of the inner walls of the hollows when being inserted into the hollows of the synthetic resin members, so that construction become simplified.

With the use of the thermally expandable fireproof material having a high coefficient of volumetric expansion and the strength of the expandable heat insulating layer thereof, the quantity of the thermally expandable fireproof material to be inserted can be reduced, so that further cost reduction can be attempted. Further, with the use of the fireproof sheet composed of the molded product comprising the resin composition, the molded product in a strip or a tape form can easily be produced using known techniques. Such molded product can be easily inserted into hollows having any shape or size. Therefore, the fireproof resin sash can conveniently be produced.

Figure 3:
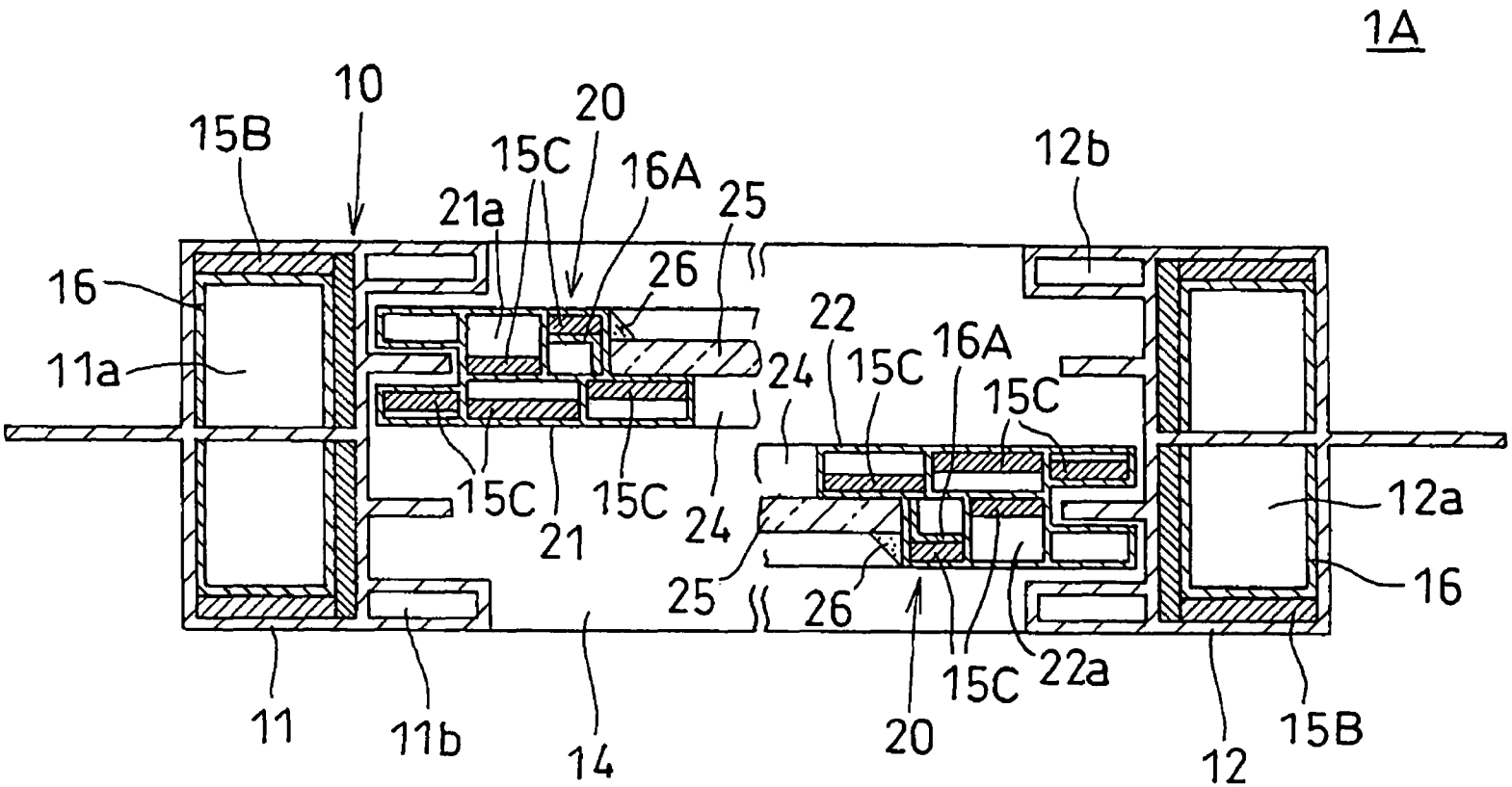
FIG. 3 shows a cross-sectional view of the main part of the second embodiment of the fireproof resin sash according to the present invention (Example 2).

The second embodiment of the present invention will be explained in detail based on FIG. 3. FIG. 3 shows a cross-sectional view of the main part of the second embodiment of the fireproof resin sash according to the present invention. With respect to the embodiment described above, the present embodiment is characterized in that rolled steel members, which are metallic members, are inserted into the hollows together with the fireproof sheets made of thermally expandable fireproof material. The rolled steel members can be inserted into some of or many of the hollows. Also, the rolled steel members may be inserted into all the hollows. Regarding other substantially equivalent constitutions, detailed explanation is omitted by adding similar reference numerals to the corresponding parts. In addition, the present embodiment corresponds to Example 2 below.

In FIG. 3, fireproof sheets 15B which have tackiness have been bonded in an L-shape to rolled steel members 16, which are metallic members, and they are inserted together into hollows 11*a* and 12*a* of the vertical frame members 11 and 12 that serve as synthetic resin members of the fireproof resin sash 1A. The cross-sectional shapes of the rolled steel members 16 have a substantially "U" shape along three surfaces of the hollows, excluding the surface of the central wall thereof. In a similar manner, the fireproof sheets and the rolled steel members are inserted into the hollows of the lateral frame members 13 and 14 (not shown). As a result, the hollows of the vertical frame members 11 and 12 have constitutions wherein all the outer circumference surfaces excluding the central wall between two hollows are reinforced with rolled steel members 16.

In addition, into four of the six hollows of the vertical rail members 21 and 22 that constitute the screens 20, fireproof sheets 15C are inserted in a tape form. The fireproof sheets are fixed to the wall surfaces parallel to the glass surfaces due to the tackiness thereof. As described above, by inserting fireproof sheets continuously into neighboring hollows along the glass surfaces, the expanded heat insulating layer is formed without gap in the event of fire so as to provide effective fireproof performance. Into one of the six hollows, a rolled steel member 16A having the cross-sectional shape bended in a substantial L shape, which has been bonded together with a fireproof sheet 15C, is inserted. In addition, into hollows of the lateral rail members 23 and 24, the fireproof sheets and the rolled steel members are inserted (not shown).

Metallic members such as rolled steel members 16 and 16A are inserted into some or all hollows of the synthetic resin members, into which the thermally expandable fireproof material may be or may not be inserted. In addition, a plurality of the rolled steel members may be inserted into a single hollow. When fireproof sheets 15B and 15C made up of thermally expandable fireproof material and the rolled steel members 16 and 16A are inserted into the same hollow, the fireproof sheets may be bonded together with the rolled steel members via the above adhesive layer or a bond layer so as to be inserted.

The rolled steel members 16 and 16A having shapes and sizes corresponding to those of hollows may be inserted as they are into the hollows for fixation. A fixation method may be used as in the case of the above thermally expandable fireproof material. When the rolled steel members 16 and 16A serving as metallic members are used, the shapes thereof are not particularly limited, on the condition that such shapes allow the members to be inserted into hollows. Examples thereof include plate shapes, groove shapes (channel), square shapes, L-shapes, mound shapes (angle steel), I-shapes (I section steel), and T-shapes. In addition, examples of the material of the rolled steel members 16 and 16A include, but are not particularly limited to, iron, stainless steel, and aluminum.

The fireproof resin sash 1A of the present embodiment has the same effects of the above embodiment. Further, the rolled steel members 16 and 16A that are metallic members to be inserted into hollows of the frame members 11-14 and the rail members 21-24, which are synthetic resin members, provide secondary effects for improving fireproof performance when synthetic resin members are burned due to fire. With the combination use of the rolled steel members, thickness of the thermally expandable fireproof material can be reduced, leading to cost reduction. Therefore, preferably, such thermally expandable fireproof material and rolled steel members are used at weak portions in terms of fire protection.

Figure 4:
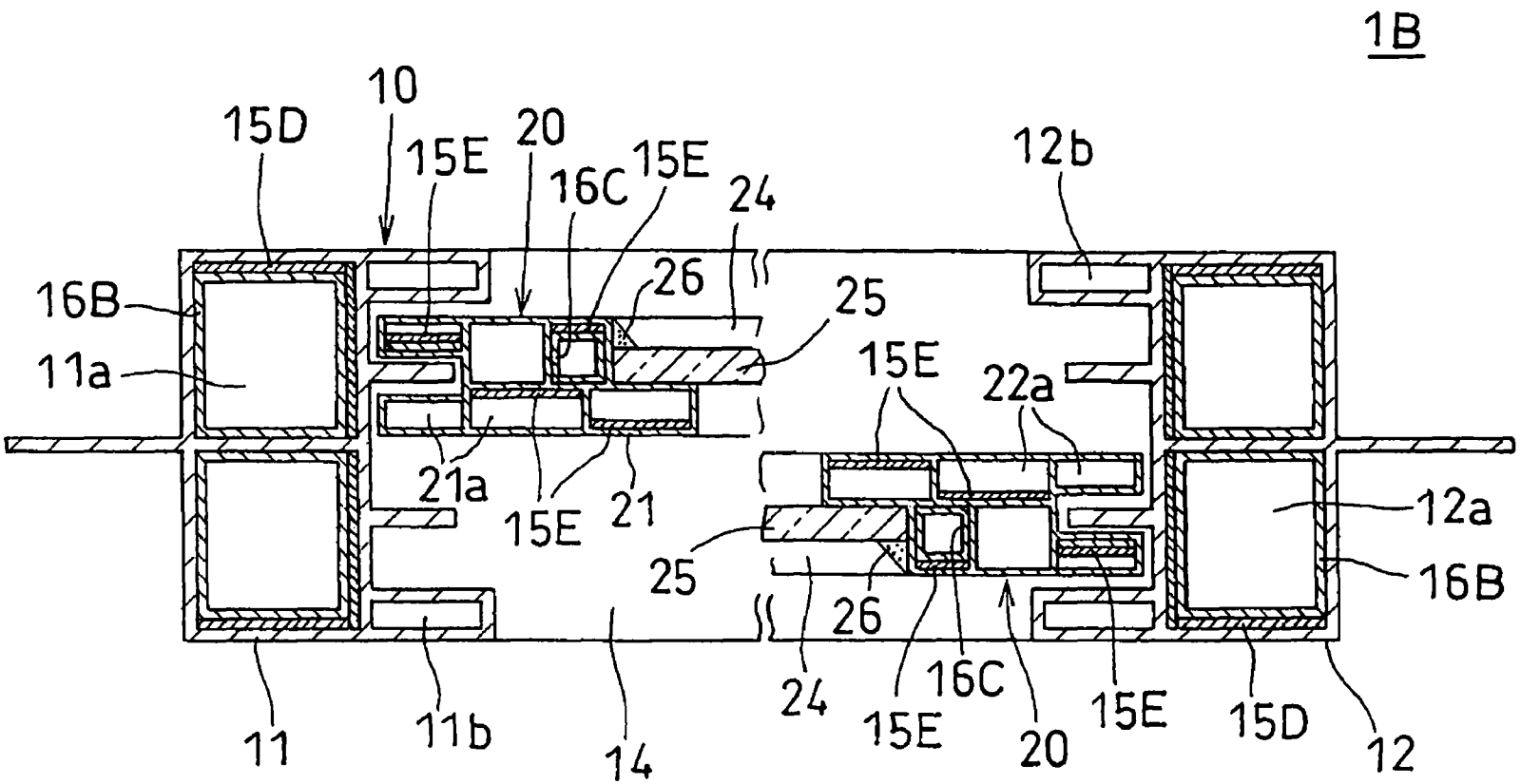
FIG. 4 shows a cross-sectional view of the main part of the second embodiment of the fireproof resin sash according to the present invention (Example 3).

FIG. 4 shows a modified example of the second embodiment of the present invention and indicates Example 3 below. The example shows a fireproof resin sash 1B, in which the fireproof sheets and the metallic members are inserted into hollows along the longitudinal direction of the synthetic resin members. The fireproof sheets used are thinner than those used in the fireproof resin sash 1A shown in FIG. 3.

Specifically, thin fireproof resin sheets 15D are bonded to two surfaces orthogonal to each other of a rolled steel member 16B, which is made of metal and square-pipe-shaped. The sheets bonded to the steel member are inserted into hollows 11*a* and 12*a* of vertical frame members that constitute the opening frame 10 in a manner such that one side of the two surfaces of the rolled steel member 16B is disposed parallel to the windowpanes, which constitute the parting plane. In addition, thin fireproof sheets are inserted into hollows of the lateral frame members in a similar manner and disposed parallel to the windowpanes (not shown). Thin fireproof sheets 15E are inserted into hollows 21*a* and 22*a* of the vertical rail members of the screens 20 and 20. Into one of the hollows, the sheets are inserted while being bonded to a rolled steel member 16C, which is made of metal and square-pipe-shaped, and are substantially tightly disposed parallel to the surface of the windowpanes 25. In addition, thin fireproof sheets are inserted into hollows of the lateral rail members and disposed in a similar manner (not shown). The fireproof resin sash 1B has effects equivalent to those provided in the above embodiments.

Figure 5:
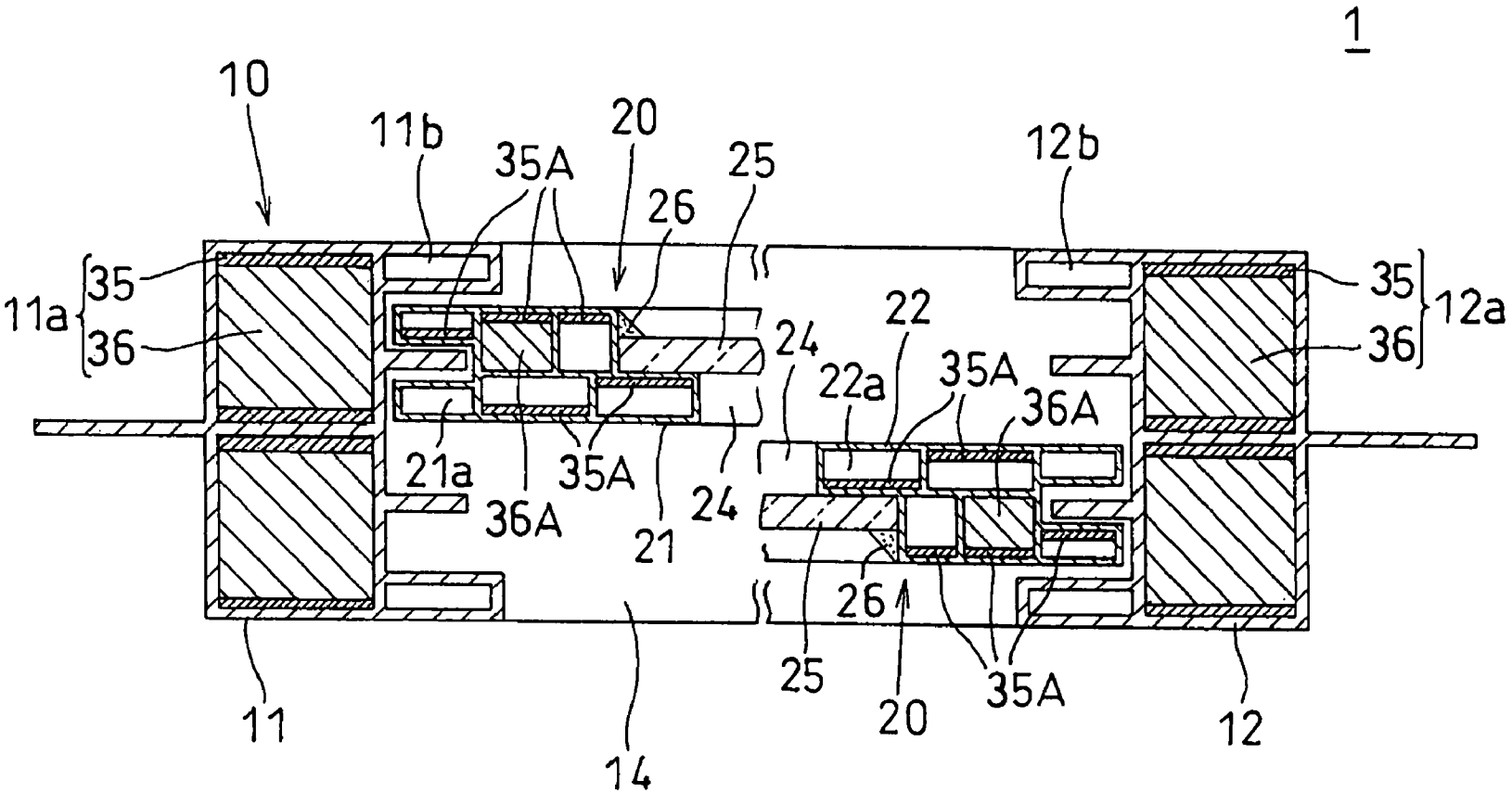
FIG. 5 shows a cross-sectional view of the main part of the third embodiment of the fireproof resin sash according to the present invention (Examples 4 and 6).

The third embodiment of the present invention will be explained in detail based on FIG. 5. FIG. 5 shows a cross-sectional view of the main part of the third embodiment of the fireproof resin sash according to the present invention. A fireproof resin sash 1C shown in the present embodiment comprises the frame members 11-14 and the rail members 21-24 that serve as the synthetic resin members that constitute the opening frame 10 and the screens 20, into the hollows of which wood members and fireproof sheets composed of the thermally expandable fireproof material are inserted.

Specifically, fireproof sheets 35, which are made by cutting a sheet of the thermally expandable fireproof material into strip forms, and wood members 36 are inserted into large hollows 11*a* and 12*a* of the vertical frame member 11. The fireproof sheets 35 have an adhesive layer on one side of each thereof so as to be bonded to opposite sides of wood members 36. The fireproof sheets 35 bonded to the wood members 36 are inserted in a manner such that the fireproof sheets are disposed on the surfaces of the inner walls of the hollows, facing the interior and the exterior sides of the vertical frame member 11. The fireproof sheets and the wood members are inserted into hollows of the lateral frame members 13 and 14 penetrating therethrough in the longitudinal direction in a similar manner (not shown). As described above, the fireproof sheets 35 are disposed parallel to the surfaces of the windowpanes 25 that constitute the parting plane so that the fireproof surfaces are formed so as to be parallel to the glass surfaces without leaving a gap therebetween.

In addition, fireproof sheets 35A, which are made by cutting a sheet of the thermally expandable fireproof material into strip forms, wood members 36A are inserted into hollows 21*a* and 22*a* of the vertical rail members 21 and 22 of the screens 20. The fireproof sheets 35A are inserted into the four hollows. A wood member 36A, to which a fireproof sheet 35A is bonded, is inserted into one hollow. The fireproof sheets 35A are plate-shaped and are inserted into hollows so as to have contact with the wall surfaces of the hollows parallel to the glass surfaces. The fireproof sheets and the wood members are inserted into hollows of the lateral frame members 23 and 24 on the top and the bottom sides of the screens 20 penetrating therethrough in the longitudinal direction in a similar manner (not shown). As described above, the fireproof sheets 35A are disposed parallel to the surfaces of the windowpanes 25 that constitute the parting plane so that the fireproof surfaces are formed parallel to the glass surfaces without leaving a gap therebetween.

Fireproof resin sheets 35 and 35A used in the present embodiment are cut in strip forms as in the case of the fireproof sheets 15-15E used in the above embodiments. The fireproof sheets are formed with the thermally expandable fireproof material so as to have the function of forming a fireproof heat insulating layer by volumetrically expanding when exposed to heat in the event of fire. In addition, the fireproof sheets are inserted into and fixed in hollows as in the case of the above embodiment. Particularly preferably, the fireproof sheets are allowed to have tackiness so as to be supported by adhesion in hollows.

The fireproof sheets 35 and 35A and the wood members 36 and 36A may be inserted together or separately into some hollows of the frame members and the rail members that are synthetic resin members. A plurality of the fireproof sheets and a plurality of the wood members may be inserted together into a single hollow. When the fireproof sheets and the wood members are inserted into a single hollow, they may be combined with each other in advance. Examples of a method whereby they can be combined with each other include fixation on the wood members using screws or a tacker, bonding via the above adhesive layer or bond layer, and a method combining both thereof.

All of the fireproof sheets 35 and 35A have been inserted into and disposed in the hollows of the frame members 11-14 and the rail members 21-24, which are synthetic resin members, such that the sheets are disposed parallel to the windowpanes 25 so as to form fireproof surfaces together with the windowpanes 25 that comprise an iron mesh and serve as fireproof plate members. Specifically, fireproof surfaces are formed with all the fireproof sheets 35 and 35A and the windowpanes 25 that substantially cover across the opening portion of the fireproof resin sash 1C.

The wood members used in the present embodiment that are inserted in the above hollows indicate elongated wood members such as wood members 36 that are inserted into hollows of the frame members 11-14, which are synthetic resin members, and wood members 36A that are inserted into hollows of the rail members 21-24. These wood members 36 and 36A are unlikely to vibrate or to be deformed due to hot wind generated in the event of fire. Thus, the wood members function to synergistically improve fireproof performance when used in combination with the fireproof sheets 35 and 35A.

Preferably, the wood members 36 and 36A that are inserted into hollows are made of a material comprising a sufficient quantity of carbonized component generated in the event of fire; that is, material having the specific gravity of 0.3 or more. Thus, fireproof performance can be improved. Examples of such wood member include solid materials such as cypress, pine, hemlock, Japanese ash, acer, Japanese oak, nyatoh, makore, moabi, zelkova, beech, lauan, teak, apitong, oak, betula, maple, and bubinga. Glued laminated woods such as LVL may be used in combination with these solid materials.

To insert the wood members 36 and 36A into hollows of the frame members 11-14 and the rail members 21-24, which are synthetic resin members, the wood members may have shapes corresponding to the shapes and the sizes of the hollows or the shapes corresponding to the widths of particular sides of each of such hollows. When the wood members 36 and 36A alone are inserted into the hollows, the length necessary for insertion is the overall length of the frame members and the rail members. When the wood members are inserted into the hollows, into which the fireproof sheets 35 and 35A are inserted, the lengths of the wood members may be shorter than such overall length on the condition that the expandable heat insulating layer, which is a component of the fireproof sheet 35 after expansion, fills the aforementioned overall length. The wood members may be inserted into hollows at any positions in a manner such that the wood members 36 and 36A fill the hollows in a continuous manner, and that the wood members 36 and 36A, the carbonized components of the synthetic resin of the frame members and the rail members, and the expandable heat insulating layers of the fireproof sheets 35 and 35A are disposed so as to be parallel to the glass surfaces of the frame members and the rail members, which are the synthetic resin members.

The thermally expandable fireproof material that constitutes the fireproof sheets 35 and 35A is not particularly limited on the condition that the portions burned due to combustion of the synthetic resin members described above are filled with expandable components. A thermally expandable fireproof material similar to one used in the above embodiment is used. Preferably, such material comprises an expandable heat insulating layer that stands without support in the event of fire. When the wood members containing a sufficient amount of carbonized component or the synthetic resin members are thick or the resin is rigid polyvinyl chloride resin, the expandable heat insulating layer causes an increase in the carbonized component in the wood members and the synthetic resin members, so that the expandable heat insulating layer may stand without support due to a composite of the carbonized component and the expandable component therein. In such case, the expandable heat insulating layer alone does not necessarily stand without support.

The fireproof resin sash 1C of the third embodiment that has the constitution described above comprises the fireproof sheets 35 and 35A composed of the thermally expandable fireproof material, which are inserted into hollows of resin members made up of synthetic resin and are disposed parallel to the surfaces of the windowpanes 25. Thus, portions burned due to combustion of the resin portion of the synthetic resin members in the event of fire can be promptly filled with the expandable heat insulating layers of the fireproof sheets, thereby preventing flame penetration. The wood members 36 and 36A are unlikely to vibrate, to warp, or to curve due to hot wind in the event of fire. Accordingly, the wood members advantageously function in terms of fireproof performance because there is no deformation of the outline of the fireproof resin sash 1, and they provide synergistic effects when used in combination with the fireproof sheets, so that the excellent fireproof performance can be obtained. Further, weak parts in terms of strength for fire protection, for example, are reinforced so that the fireproof performance is secondarily improved, leading to cost reduction.

In addition, fireproof surfaces that cover the substantially entire surface parallel to the glass surfaces by being filled with a fireproof material are formed with the fireproof sheets 35 that have been inserted into the opening frame 10, the fireproof sheets 35A that have been inserted into the rail members that constitute the outer circumference frame of the screens 20 and 20, and the windowpanes 25 that are fireproof plate members disposed on the inner side of the outer circumference frame. Thus, there is no localized weak part in the fireproof resin sash 1C in the event of fire. Therefore, fireproof performance becomes stable.

Further, with the use of thermally expandable fireproof material having a high coefficient of volumetric expansion and strength after heat insulating expansion, the quantity of thermally expandable fireproof material to be inserted can be reduced, so that further cost reduction can be attempted. In addition, with the use of the fireproof sheet that is a molded product composed of a resin composition, molded products in strip or tape forms can easily be produced using known techniques. Such molded products can easily be inserted into hollows regardless of the shapes or the sizes thereof so that the fireproof resin sash can be conveniently produced.

Figure 6:
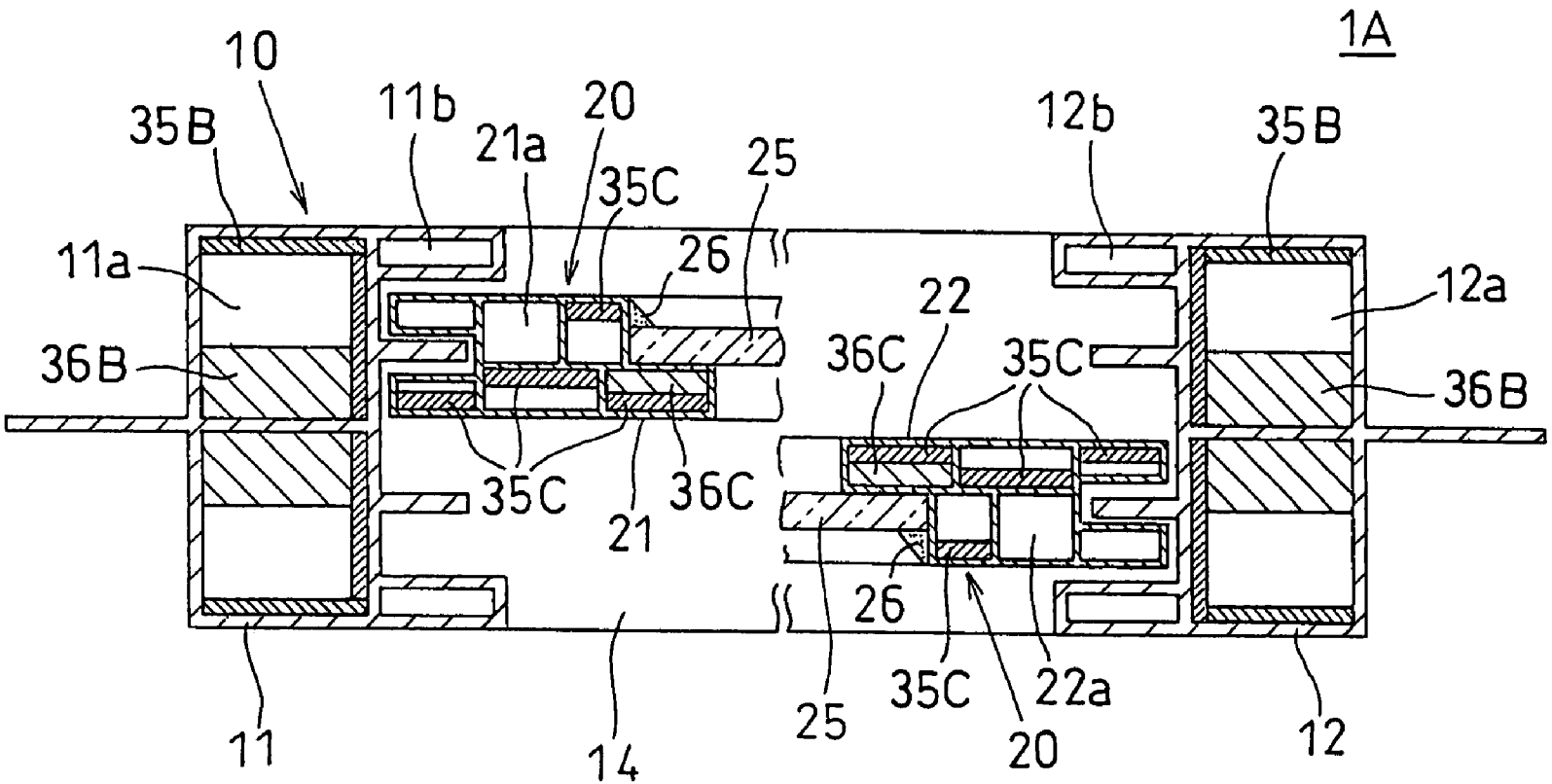
FIG. 6 shows a cross-sectional view of the main part of the third embodiment of the fireproof resin sash according to the present invention (Example 5).

A modified example of the third embodiment of the present invention will be explained in detail based on FIG. 6. FIG. 6 shows a cross-sectional view of the main part of the modified example of the third embodiment of the fireproof resin sash according to the present invention. Compared with the above embodiment, the present embodiment is characterized in that the wood members are inserted into hollows together with fireproof sheets made up of thermally expandable fireproof material, while leaving certain spaces therein. Regarding other substantially equivalent constitutions, detailed explanation is omitted by adding the similar reference numerals to the corresponding parts. In addition, the present embodiment corresponds to Example 5 below.

In FIG. 6, fireproof sheets 35B in tape forms are inserted into hollows 11*a* and 12*a* of the vertical frame members 11 and 12 that are synthetic resin members of the fireproof resin sash 1D in a manner such that two sheets thereof are combined and inserted together so as to result in an L-shaped cross-section. Further, wood members 36B are inserted into the hollows 11*a* and 12*a* while leaving spaces therein. Fireproof sheets 35C in tape forms are inserted into three of the six hollows of the vertical rail members 21 and 22 that constitute the screens 20, and are fixed to the surfaces of the walls parallel to the glass surface due to tackiness of the fireproof sheets. In addition, into one hollow, a wood member 36C having bonded together with a fireproof sheet 35C is inserted without leaving a gap therein. With such constitution, the quantity of the thermally expandable fireproof material can be reduced as in the case of the above embodiment, so that cost reduction can be achieved and the fireproof resin sash 1D having a reduced weight can be produced.

The fireproof sheets 35B and 35C that are inserted into hollows of the frame members and the rail members of the fireproof resin sash 1D shown in the present embodiment are disposed parallel to the surfaces of the windowpanes 25, so as to form fireproof surfaces without leaving gaps therebetween. Thus, in the event of fire, the wide surfaces thereof are heated so that the sheets immediately thermally expand, and a fireproof heat insulating layer is formed without gap. Therefore, fireproof performance can be promptly and stably provided so as to ensure protection against the spread of fire.

In addition, fireproof surfaces that cover the substantially entire surface parallel to the parting surface by being filled with fireproof members are formed with the fireproof sheets 35B that have been inserted into the opening frame 10, the fireproof sheets 35C that have been inserted into the rail members that constitute outer circumference frames of the screens 20 and 20, and the windowpanes 25 that are a fireproof plate members disposed on the inner side of the outer circumference frames, resulting in no weak part locally being found in the event of fire. Therefore, a fireproof structure that provides stable fireproof performance can be obtained.

Into hollows of the synthetic resin members, the thermally expandable fireproof material, the rolled steel members, or the wood members are inserted as described above. They may be inserted together, in combinations of two, or they may be inserted separately into the hollows. The combined use of the rolled steel members and the wood members causes synergistic expression of fireproof effects thereof, resulting in further improved fireproof performance.

In addition, some of the rolled steel members that are inserted into hollows of the synthetic resin members may be replaced with wood members. Preferably, the weight of the fireproof resin sash can be reduced by replacing the rolled steel members with the wood members. In such constitution of the fireproof resin sash, the wood members and the thermally expandable fireproof material are used in combination so as to form continuous fireproof surfaces. Accordingly, such combined use provides synergistic effects for improving fireproof performance, and the metallic members provide secondary effects for improving fireproof performance, so that the fireproof performance of the fireproof resin sash can be further improved in a comprehensive manner.

To further improve suppression of deformation or heat insulating properties of synthetic resin of the frame members and rail members of the resin sash upon heating, synthetic resin, foam, inorganic materials excluding metals, and the like may be simultaneously inserted into hollows.

Examples of the synthetic resin to be simultaneously inserted as described above include, but are not particularly limited to, rigid polyvinyl chloride and ABS resin. Examples of foam to be simultaneously inserted into hollows include, but are not particularly limited to, phenol foam, urethane foam, polyethylene foam, polypropylene foam, polystyrene foam, these foams filled with inorganic powder such as aluminum hydroxide, and inorganic foams.

Examples of inorganic materials to be simultaneously inserted into hollows excluding metals include, but are not particularly limited to, gypsum board, calcium silicate board, fiber reinforced gypsum board, autoclaved lightweight concrete (ALC) board, extruded cement board, PC board, and earthenware.

Next, examples using the present invention and comparative experimentation with general synthetic resin sashes will be explained.

EXAMPLES 1-7

Resin compositions were obtained by kneading the following materials using a kneader with the contents (parts by weight) shown FIGS. 8 and 9: epoxy monomer ("E807," Japan Epoxy Resins); epoxy hardener ("FL052," Japan Epoxy Resins); butyl rubber ("butyl rubber 065," ExxonMobil Chemical); polybutene ("polybutene 100R," Idemitsu Petrochemical); hydrogenated petroleum resin ("Escorez 5320," Tonex); ammonium polyphosphate ("Exolit AP 422," Clariant); thermally expandable graphite ("GREP-EG," Tosoh); aluminum hydroxide ("B 325," Alcoa); and calcium carbonate ("BF 300," Bihoku Funka Kogyo).

Example 1

The resin composition obtained by the above method was formed into a sheet using a roll coater while a polyethylene-laminated polyester nonwoven fabric was laminated on one side thereof, followed by curing in a furnace. Then, a sheet-like molded product having a thickness of 1 mm was obtained. The obtained sheet-like molded product was coated with acrylic resin adhesive and was cut using a cutter to widths corresponding to those of hollows into which the molded product was to be inserted. Thus, the molded product in strip forms having an adhesive layer on one side of each such strip form was prepared.

Fireproof sheets 15 and 15A, comprised of the prepared molded products in strip forms, were inserted into hollows of an opening frame 10 and screens 20 of double sliding windows shown in FIGS. 1 and 2, and were fixed at positions shown in FIG. 2 via the adhesive layer. Also, the fireproof sheets with specifications similar to those in the case of the rail members were inserted at a meeting point of the two screens (not shown in FIG. 2), so as to prepare a rigid polyvinyl chloride resin sash 1.

Example 2

The resin composition obtained by the above method was laminated on the aluminum foil side of aluminum foil laminated release paper by calendering molding so as to prepare a rolled molded product having a thickness of 3 mm. Then, the molded product was cross-sectioned using a cross-section cutter to widths corresponding to those of hollows, into which the molded product was to be inserted, so that fireproof sheets 15B and 15C were obtained. The fireproof sheets 15B and 15C were bonded together with grooved-shaped or L-shaped rolled steel members 16A by means of the inherent tackiness of the resin composition thereof, and were inserted into hollows of an opening frame 10 and screens 20 as shown in FIG. 3. In addition, fireproof sheets 15C were inserted into hollows of the screens 20 and were fixed therein by means of tackiness of the sheets. Further, fireproof sheets and rolled steel members with specifications similar to those in the case of the rail members were inserted at a meeting point of the two screens (not shown in FIG. 3), so as to prepare a rigid polyvinyl chloride resin sash 1A.

Example 3

The resin composition obtained by the above method was formed into a sheet by an SMC manufacturing process while glass cloth was impregnated therewith, followed by curing in a furnace. Then, a sheet-like molded product having a thickness of 1 mm was obtained. To one side of the obtained sheet-like molded product, an acrylic resin-based double-faced adhesive tape was applied. Then, the molded product was prepared in strip forms having adhesive layers on one side of each thereof using a cutter so as to result in widths corresponding to the widths of hollows, into which the molded product were to be inserted. Thus, fireproof sheets 15D and 15E were obtained. The sheets 15D and 15E were bonded together with square-shaped rolled steel members 16B and 16C, and were inserted into hollows of an opening frame 10 and screens 20 as shown in FIG. 4. In addition, fireproof sheets 15E were inserted into hollows of screens 20 and were fixed therein via the tackiness thereof. Further, fireproof sheets and rolled steel members with specifications similar to those in the case of the rail members were inserted at a meeting point of the two screens (not shown in FIG. 4), so as to prepare a rigid polyvinyl chloride resin sash 1B.

Example 4

The resin composition obtained by the above method was formed into a sheet using a roll coater while a polyethylene-laminated polyester nonwoven fabric was laminated on one side thereof, followed by curing in a furnace. Then, a sheet-like molded product having a thickness of 1 mm was obtained. The obtained sheet-like molded product was coated with acrylic resin adhesive and was cut using a cutter to widths corresponding to the widths of hollows, into which the pieces of the molded product were to be inserted. Thus, the molded product was prepared in strip forms having an adhesive layer on one side of each thereof.

Fireproof sheets 35 and 35A, the prepared strips of the molded product were bonded with wood members 36 and 36A made of hemlock that had sizes corresponding to those of hollows of an opening frame 10 and screens 20 of a double sliding window shown in FIG. 5. They were fixed together using a tacker and inserted into the hollows. In addition, the fireproof sheets alone were inserted into the hollows and fixed therein via an adhesive layer thereof. Also, fireproof sheets with specifications similar to those in the case of the rail members were inserted at a meeting point of the two screens (not shown in FIG. 5), so as to prepare a rigid polyvinyl chloride resin sash 1C.

Example 5

The resin composition obtained by the above method was laminated on the aluminum foil side of aluminum foil laminated release paper by calendering molding so as to prepare a rolled molded product having a thickness of 1.5 mm. Then, the molded product was cross-sectioned using a cross section cutter to widths corresponding to those of the hollows, into which the molded product strips were to be inserted, so that fireproof sheets 35B, tape-like strips of the molded product, were obtained. The sheets were inserted into the hollows and fixed therein due to the inherent tackiness of the resin composition thereof. In addition, wood members 36B made of hemlock having short depths corresponding to the widths of hollows, into which the sheets were to be inserted, were inserted into the hollows while leaving spaces therein as shown in FIG. 6. Further, fireproof sheets with specifications similar to those in the case of the rail members were inserted at a meeting point of the two screens (not shown in FIG. 6), so as to prepare a rigid polyvinyl chloride resin sash 1D.

Example 6

A rigid polyvinyl chloride resin sash 1D was prepared as in the case of Example 4, except that wood members 36A made of Japanese ash glued laminated wood were used.

Example 7

A rigid polyvinyl chloride resin sash was prepared with an opening frame into which L-shaped rolled steel members having the resin composition used in Example 5 bonded thereto were inserted, and with screens into which the resin composition and the wood members made of hemlock used in Example 4 were inserted.

Comparative Example 1

Figure 7:
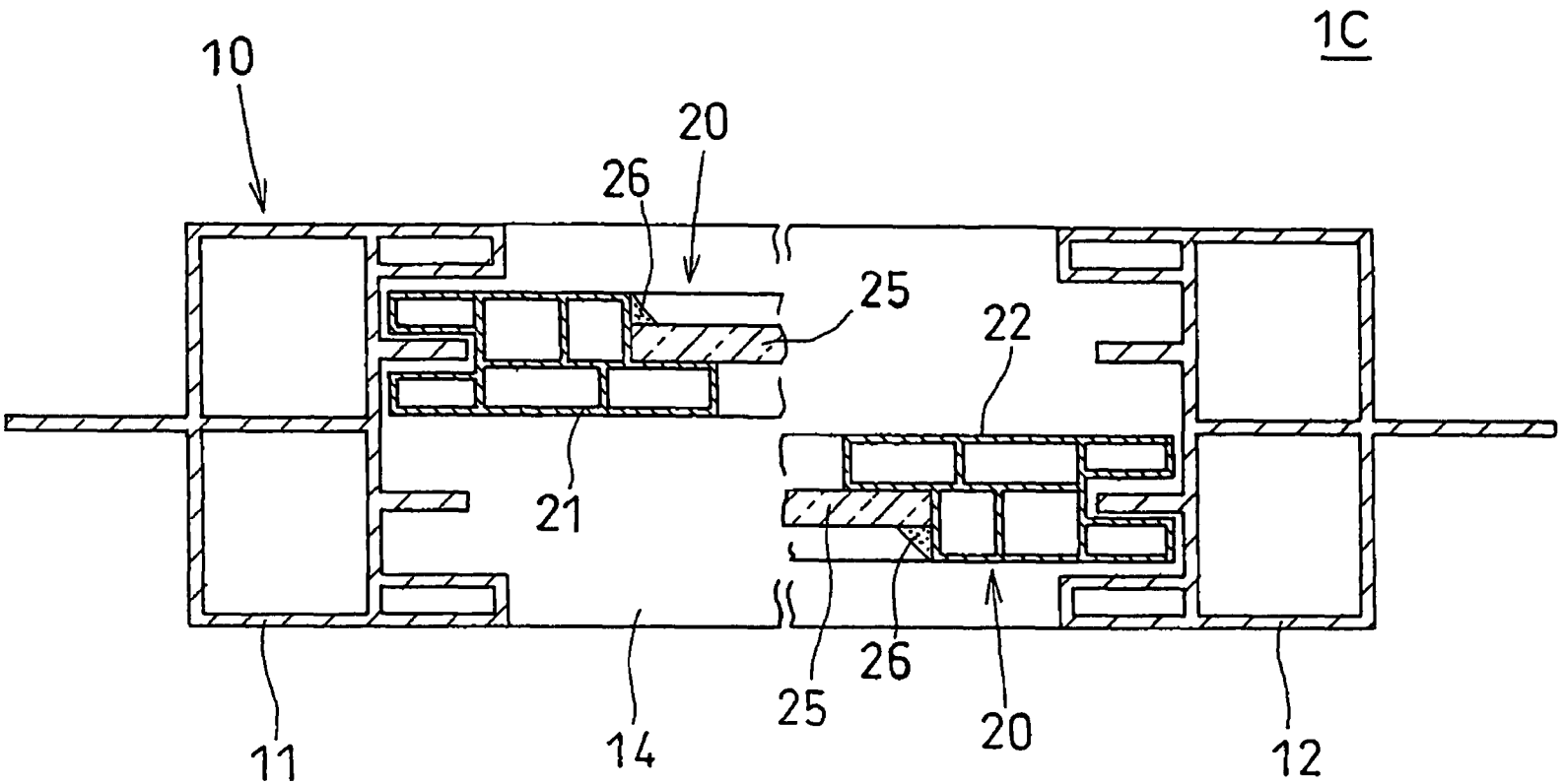
FIG. 7 shows a cross-sectional view of the main part of the synthetic resin sash in the Comparative Example.

As shown in FIG. 7, a rigid polyvinyl chloride resin sash 1E was prepared without inserting thermally expandable fireproof material, rolled steel members, or wood members.

The evaluation results of Examples 1-7 and Comparative Example 1 obtained by a method described below are shown in FIGS. 8 and 9.

(1) Coefficient of volumetric expansion: A coefficient of volumetric expansion was calculated by the following formula, followed by measurement of the size of a sample (length: 100 mm; width: 100 mm; thickness: as shown in FIGS. 8 and 9) after heating for 30 minutes under radiant heat flux of 50 kW/m$^2$ using a cone calorimeter ("CONE 2A," Atlas).

Coefficient of volumetric expansion={length after heating (mm)×width after heating (mm)×thickness after heating (mm)}/{100×100×thickness before heating (mm)}

(2) Breaking point stress: The stress at a breaking point of the sample after volumetric expansion described above was measured using a compression tester (Finger Feeling Tester, Kato Tech) with an indenter of 0.25 cm$^2$ at a compression speed of 0.1 m/s.

(3) Fireproof performance: A fireproof test was carried out for 20 minutes in conformity with ISO 834. Among the rigid polyvinyl chloride resin sashes obtained above, those that did not catch fire on the backsides thereof or experience flame penetration therethrough within 20 minutes and those that did catch fire on the backsides thereof or experience flame penetration therethrough within 20 minutes are indicated with G (Good) and P (Poor), respectively. As shown in FIGS. 8 and 9, evaluation results of fireproof performance were G in Examples 1-7 and the result was P in Comparative Example 1, so that the reliable fireproof performance of the fireproof resin sashes obtained in the embodiments of the present invention was confirmed.

The embodiments of the present invention were described above in detail. The technical scope of the present invention is not limited to the above embodiments, and various modifications can be made without departing from the spirit and scope of the invention described in claims. For instance, examples of the metallic members presented above include those made of rolled steels; however, metal materials such as aluminum or aluminum alloys may be used. Hollows of the vertical and lateral frame members and vertical and lateral rail members may have an opening, and the opening may be closed with a rolled steel member.

In addition, examples of the fireproof resin sash presented above include, but are not limited to the sash for sliding glass doors composed of screens. Such sash may be adequately applied to vertically movable glass doors, fixed glass doors, metal doors, revolving-type opening and closing doors and fixed doors, and sliding doors.

Further, examples of the fireproof plate members supported by the fireproof resin sashes presented above include windowpanes made of wired glass. A metal plate may be used to serve as a flat faceplate. That is, screen parts that constitute the fireproof resin sash comprise frame-like a rail body that surrounds the outer circumference of the screen parts and fireproof plate members installed inside of the rail body, and a metal faceplate may be used to serve as such fireproof plate member.

INDUSTRIAL APPLICABILITY

As is understood from the above description, in the fireproof resin sash according to the present invention, the thermally expandable fireproof material is inserted into hollows of the members that constitute the resin sash so that fireproof performance can conveniently be imparted to general non-fireproof resin sashes. Thus, the fireproof resin sash of the present invention can be used in fire zones and the like. In addition, weight reduction with regard to the same can be attempted, so that opening and closing operations can easily be performed. Further, by inserting metallic members and/or wood members into hollows, fireproof performance can be improved. The thermally expandable fireproof material that is disposed parallel to the parting plane immediately expands in the event of an outbreak of fire. Thus, fireproof performance can promptly be provided. The thermally expandable fireproof material is supported by adhesion on the inner surfaces of hollows, so that construction can be simplified.

The invention claimed is:

1. A fireproof resin sash, which comprises synthetic resin members that are composed of vertical and lateral frame members and vertical and lateral rail members, the synthetic resin members each having a plurality of hollows along the longitudinal directions thereof and which supports fireproof plate members, wherein fireproof sheets are inserted into selected hollows of the rail members and disposed in the hollows so that a broad surface corresponding to a long side of the cross-section thereof is in the direction along the broad surfaces of the plate members, said fireproof sheets being made up of a metallic member bonded together with thermally expandable fireproof material, and the fireproof sheets are inserted into hollows while leaving a space therein, wherein when the fireproof resin sash is heated, the thermally expandable fireproof material expands in volume and forms fireproof heat insulating layers without gaps, and the thermally expandable fireproof material is formed with a resin composition material comprising 10 to 300 parts by weight of thermally expandable graphite, 30 to 400 parts by weight of inorganic filler and metal carbonates, and 30 to 300 parts by weight of ammonium polyphosphate, wherein the sum of the thermally expandable graphite, the inorganic filler and metal carbonates, and the ammonium polyphosphate is 70 to 500 parts by weight, with respect to 100 parts by weight of a resin component.

2. The fireproof resin sash according to claim 1, which comprises metallic members or wood members that are further inserted into the hollows along the longitudinal direction thereof.

3. The fireproof resin sash according to claim 1, which comprises the fireproof sheets supported by adhesion on inner surfaces of the hollows.

4. The fireproof resin sash according to claim 1, wherein the particle size of the thermally expandable graphite is between 20 mesh to 200 mesh.

5. The fireproof resin sash according to claim 1, which comprises metallic members and wood members that are further inserted into the hollows along the longitudinal direction thereof.

* * * * *